US011724507B2

(12) United States Patent
Fukasawa et al.

(10) Patent No.: US 11,724,507 B2
(45) Date of Patent: Aug. 15, 2023

(54) INK REFILLING CONTAINER

(71) Applicant: SEIKO EPSON CORPORATION, Tokyo (JP)

(72) Inventors: Noriyuki Fukasawa, Matsumoto (JP); Seigo Miyazawa, Shiojiri (JP); Tadashi Watanabe, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 21 days.

(21) Appl. No.: 17/507,944

(22) Filed: Oct. 22, 2021

(65) Prior Publication Data

US 2022/0126592 A1 Apr. 28, 2022

(30) Foreign Application Priority Data

Oct. 23, 2020 (JP) ..... 2020-178059

(51) Int. Cl.
*B41J 2/175* (2006.01)
*B41J 2/13* (2006.01)

(52) U.S. Cl.
CPC ..... *B41J 2/17506* (2013.01); *B41J 2/13* (2013.01); *B41J 2/17596* (2013.01)

(58) Field of Classification Search
CPC .... B41J 2/175; B41J 2/17506; B41J 2/17509; B41J 2/17513; B41J 2/17523; B41J 2/17536; B41J 2/17553; B41J 2/17566; B41J 29/02; B41J 29/13; B41J 2002/17573; B41J 2002/17579; B65D 47/123
See application file for complete search history.

(56) References Cited

U.S. PATENT DOCUMENTS

| | | | | |
|---|---|---|---|---|
| 6,079,823 | A * | 6/2000 | Droege | B41J 2/17509 347/85 |
| 7,128,245 | B2 * | 10/2006 | Lee | B65D 47/0809 222/562 |
| 8,608,034 | B2 * | 12/2013 | Bloom | B65D 51/18 222/490 |
| 10,618,292 | B2 | 4/2020 | Fukasawa et al. | |
| 2018/0154645 | A1 * | 6/2018 | Rooney | B41J 2/17536 |
| 2018/0250943 | A1 | 9/2018 | Fukasawa et al. | |
| 2020/0307872 | A1 | 10/2020 | Nagai et al. | |

FOREIGN PATENT DOCUMENTS

| | | | |
|---|---|---|---|
| JP | 2016-050007 | A | 4/2016 |
| JP | 2018-134830 | A | 8/2018 |
| JP | 2018-144239 | A | 9/2018 |
| JP | 2020-164231 | A | 10/2020 |
| WO | 2020/017617 | A1 | 1/2020 |

* cited by examiner

*Primary Examiner* — Anh T Vo
(74) *Attorney, Agent, or Firm* — Oliff PLC

(57) ABSTRACT

An ink refilling container includes a bottle and a cap. The bottle includes an ink outlet forming portion including an ink outlet and a valve. The valve has valve segments segmented by slits. The cap includes a top portion, which faces the ink outlet when the cap is put on the bottle. A protruding portion extending in the central axis direction is provided at the center of the top portion. An annular-shaped sealing portion is provided on the top portion radially outside the protruding portion. The radius of the protruding portion is less than the length of the slit. In a sealed state wherein the cap is in thread engagement with the bottle and wherein the sealing portion seals the ink outlet, the tip end of the protruding portion is inserted in the inside of the bottle through the slits at the center region of the ink outlet.

5 Claims, 16 Drawing Sheets

INK REFILLING CONTAINER

The present application is based on, and claims priority from JP Application Serial Number 2020-178059, filed Oct. 23, 2020, the disclosure of which is hereby incorporated by reference herein in its entirety.

BACKGROUND

1. Technical Field

The present disclosure relates to an ink refilling container.

2. Related Art

A cap having a slit valve and configured to be attached to a container containing liquid or the like in a dischargeable manner is disclosed in JP-A-2016-050007. This cap includes a cap base, a slit valve mounted on the opening of the cap base, and a lid body for opening and closing the opening of the cap base. In this cap, in a state in which the lid body is closed, a dome-shaped convex portion provided on the lid body pushes the slit valve, thereby pushing the slit valve open slightly to prevent the content from adhering to the slit valve.

In the cap described in the above paragraph, if the dome-shaped convex portion pushes the outer-circumference-side end of the slit valve, the creep deformation of the valve occurs in a state of receiving a force toward the outer circumference, and there is a possibility that the slit will remain open undesirably. If the container is directed downward with the lid body open, the dripping of the content through the slit valve is likely to occur. If the amount of pushing the slit valve by the convex portion is decreased in order to suppress the creep deformation, even if the internal pressure of the container increases due to a rise in temperature, etc., the pressure will not be released sufficiently. Therefore, when the container is turned upside down, there is a risk that the spouting of the content of the container might occur due to the exceeding of the sum of the increased pressure and the liquid head pressure of the content over the pressure resistance of the valve.

SUMMARY

In a first aspect of the present disclosure, an ink refilling container is provided. The ink refilling container includes: a bottle; and a cap configured to be put on the bottle detachably; the bottle including an ink outlet forming portion that includes an ink outlet, a valve provided inside of the ink outlet and an outer circumferential portion, the ink outlet having a cylindrical shape, a first thread portion being formed on the outer circumferential portion, wherein the valve is made of an elastic material and includes valve segments segmented by at least one slit extending in a radial direction from a center of the ink outlet toward an outer circumference; the cap including a barrel portion having a cylindrical shape and including an inner circumferential portion on which a second thread portion configured to engage with the first thread portion is formed; and a top portion configured to face the ink outlet when the cap is put on the bottle; wherein a protruding portion extending in a direction of a central axis of the barrel portion is provided at a center of the top portion, a sealing portion having an annular shape is provided on the top portion outside the protruding portion in the radial direction, a radius of the protruding portion is set to be less than a length of the slit as viewed in a direction of a central axis of the ink outlet when the valve is closed, and in a sealed state in which the cap is in thread engagement with the bottle and in which the sealing portion seals the ink outlet tightly, a tip end of the protruding portion is inserted in an inside of the bottle through the slit at a center region of the ink outlet as viewed in the direction of the central axis of the ink outlet.

DESCRIPTION OF EXEMPLARY EMBODIMENTS

A. First Embodiment

Figure 1:
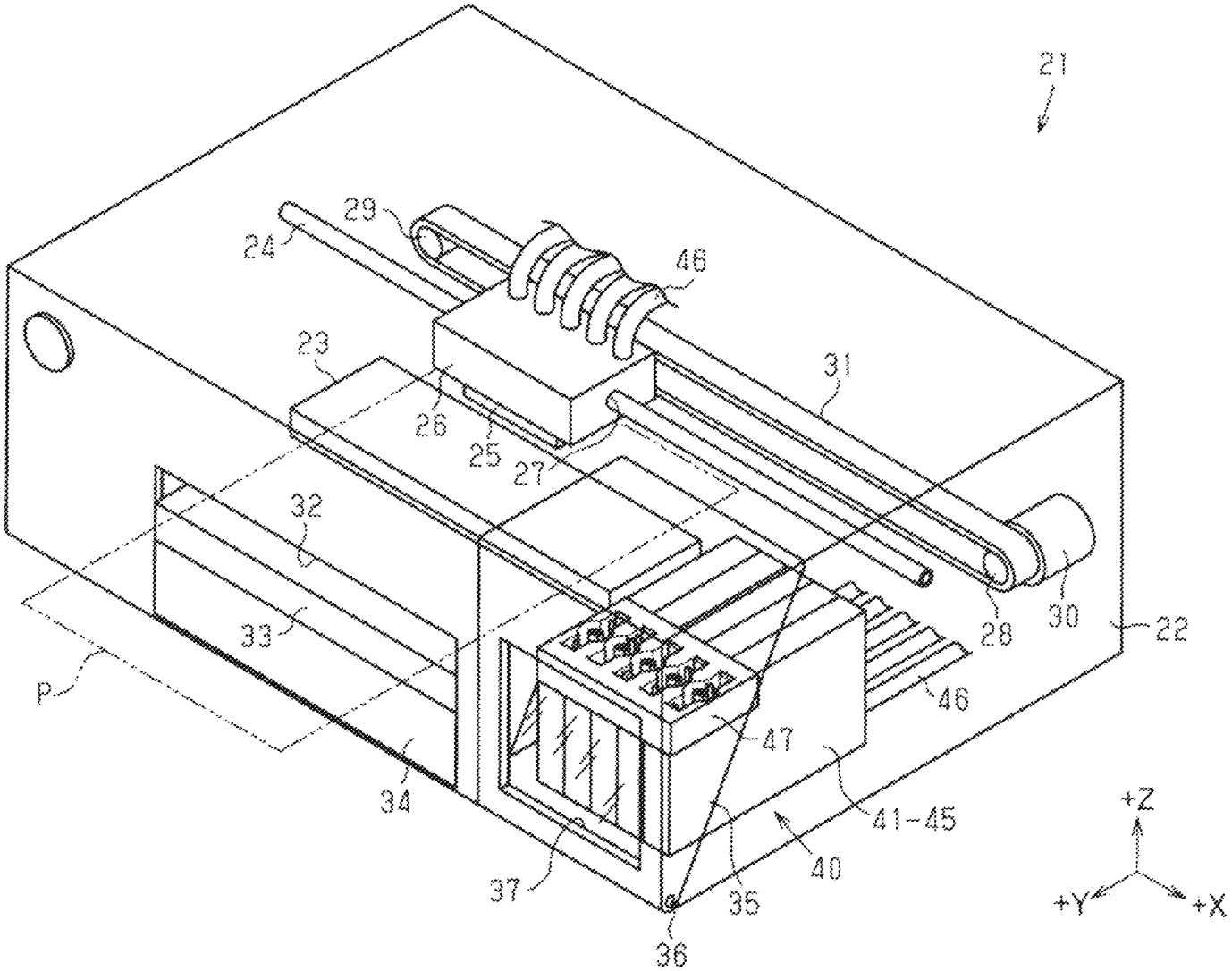
FIG. 1 is a schematic perspective view of an exemplary structure of a recording apparatus, illustrated in a see-through state, with omission of details.

FIG. 1 is a schematic perspective view of an exemplary structure of a recording apparatus 21 according to a first embodiment, illustrated in a see-through state with omission of details. The recording apparatus 21 is an ink-jet printer that records an image, etc. on a medium by ejecting ink onto the medium. In FIG. 1, X, Y, and Z directions, which are orthogonal to one another, are shown. The X direction and the Y direction are parallel to the horizontal direction. The Z direction is parallel to the vertical direction. The X direction will be referred to also as "leftward/rightward direction", wherein the direction toward the right is denoted as +X, and the direction toward the left is denoted as −X. The Y direction will be referred to also as "frontward/rearward direction", wherein the direction toward the front is denoted as +Y, and the direction toward the rear is denoted as −Y. The Z direction will be referred to also as "top/bottom direction", wherein the direction toward the top is denoted as +Z, and the direction toward the bottom is denoted as −Z. When two objects are described as "intersecting with each other" below, it means any of the following states: a state in which the two objects intersect with each other actually"; a state in which an extension of" one of the two objects intersects with the other; and a state in which an extension of one of the two objects and an extension of the other intersect with each other.

The recording apparatus 21 includes a housing 22. The housing 22 has a shape of a rectangular parallelepiped whose longitudinal direction is along the leftward/rightward direction. A platen 23 whose longitudinal direction is along the leftward/rightward direction is provided at a floor position closer to the rear inside the housing 22, with the top surface of the platen 23 lying substantially along the horizontal direction. Paper P, which is an example of a medium, is transported frontward while being supported by the top surface of the platen 23. A guide shaft 24 extending in the leftward/rightward direction is provided above the platen 23 inside the housing 22. A carriage 26, on the bottom face of which a recording head 25 configured to eject ink is mounted, is supported on the guide shaft 24. The carriage 26 has a support hole 27 going through itself in the leftward/rightward direction. The carriage 26, with the guide shaft 24 inserted through the support hole 27, is supported in such a way as to be able to reciprocate freely along the guide shaft 24.

A driving pulley 28 and a driven pulley 29 are supported rotatably at respective positions near the two ends of the guide shaft 24 inside the housing 22. The output shaft of a carriage motor 30 is coupled to the driving pulley 28. An endless timing belt 31, a part of which is fixed to the carriage 26, is stretched between the driving pulley 28 and the driven pulley 29. The carriage 26 is driven by the carriage motor 30 via the timing belt 31 to reciprocate in the leftward/rightward direction, which is the direction of scan over the paper P, while being guided by the guide shaft 24. When the carriage 26 reciprocates in this way, ink is ejected toward the paper P, which is transported on the platen 23 frontward, from the recording head 25 mounted on the bottom face of the carriage 26.

A rectangular ejection port 32 is provided as an opening in the front face of the housing 22 at a position in front of the platen 23. Recording is performed on the paper P by ejecting ink from the recording head 25 toward the paper P when the paper P is transported on the platen 23 inside the housing 22, and then, the recorded paper is ejected frontward through the ejection port 32. An ejection tray 33, which has a shape of a rectangular plate and is able to support the paper P ejected from the inside of the housing 22, is provided in the ejection port 32 such that the ejection tray 33 is able to be put into a drawn-out protruding position frontward, that is, in the direction of ejection, and is able to be put into a retracted position inside the housing 22. A paper feed cassette 34, inside which sheets of paper P to be used for recording can be housed in a stacked state, is detachably attached under the ejection tray 33 in the ejection port 32 such that the paper feed cassette 34 can be inserted rearward and drawn out frontward.

An openable-and-closable door 35 is provided on the front of the housing 22 at one end position in the leftward/rightward direction, specifically, at the right end position in the present embodiment. The openable-and-closable door 35 has a rectangular surface shape on its front, a rectangular surface shape on its top, and a right-angled triangular surface shape on its right side. The openable-and-closable door 35 has a pivot 36 extending in the leftward/rightward direction at its bottom end position. The openable-and-closable door 35 is able to open frontward and close rearward by turning around the pivot 36 freely. A window portion 37, which is made of a rectangular transparent member, is formed in the front of the openable-and-closable door 35. A user is able to see the inside of the housing 22, in particular, the portion behind the front of the openable-and-closable door 35, through the window portion 37, even without opening the openable-and-closable door 35.

An ink supply unit 40 is housed inside the housing 22 of the recording apparatus 21 at a position behind the openable-and-closable door 35 near the front face and near one end, specifically, near the right end in the present embodiment. The ink supply unit 40 supplies ink to the recording head 25. The ink supply unit 40 includes a plurality of ink tanks, specifically, five ink tanks 41 to 45 in the present embodiment, and is configured as an integrated structure body that can be handled together. As will be described later, it is possible to refill each of the ink tanks 41 to 45 with ink.

Figure 2:
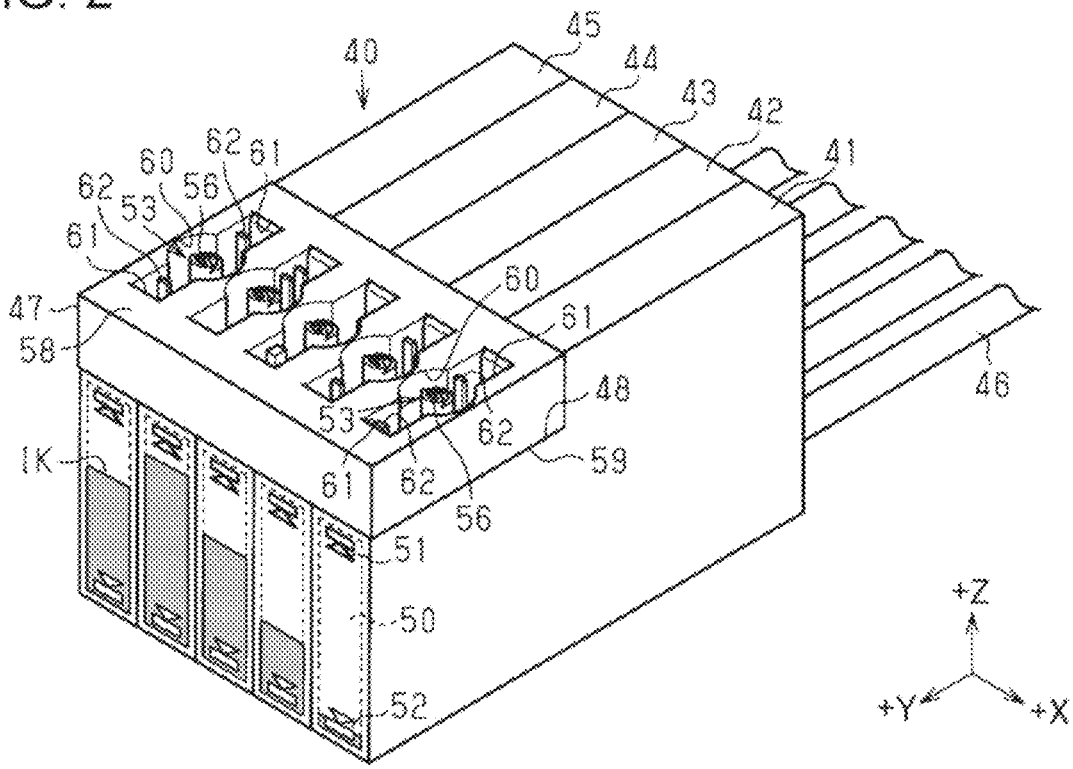
FIG. 2 is a perspective view of an ink supply unit.
Figure 3:
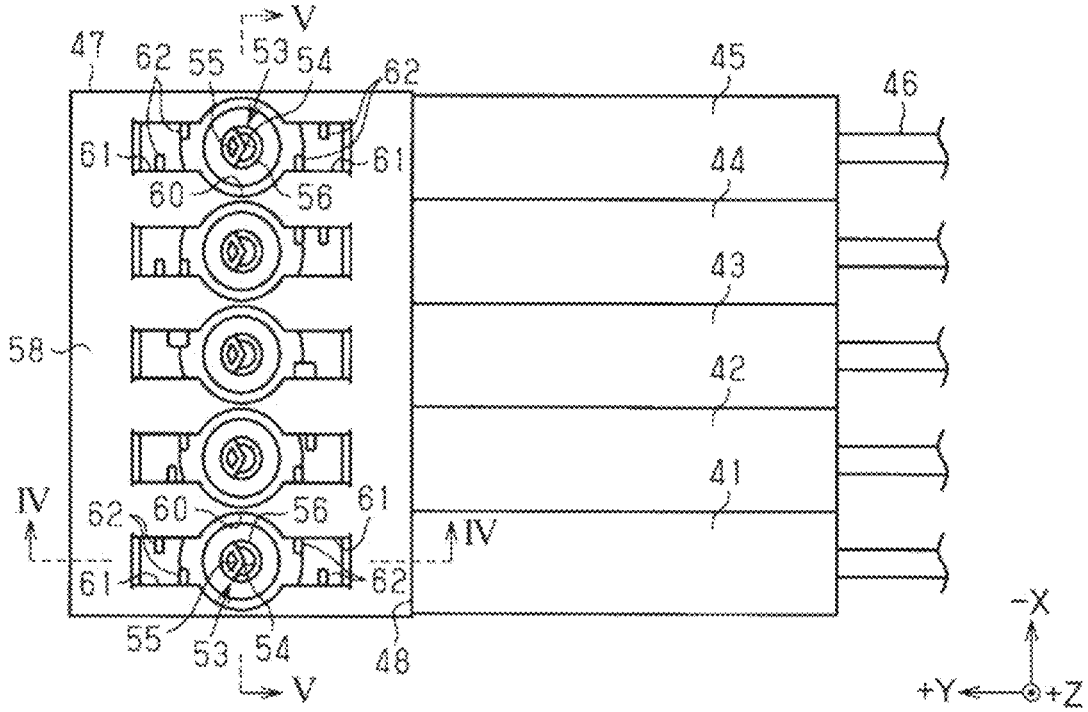
FIG. 3 is a plan view of the ink supply unit.

FIG. 2 is a perspective view of the ink supply unit 40. FIG. 3 is a plan view of the ink supply unit 40. The ink supply unit 40 includes the five ink tanks 41 to 45, each of which has an elongated box-like shape whose longitudinal direction is along the frontward/rearward direction, five ink supply tubes 46, which are routed from the rear of the ink tanks 41 to 45 respectively, and an ink refilling adapter 47, which has a shape of a rectangular parallelepiped and is attached to the ink tanks 41 to 45 all together. The ink refilling adapter 47 is integrated with the ink tanks 41 to 45 by being mounted onto a stepped portion 48, which is formed as a cutout in the top-and-front part of each of the plurality of ink tanks 41 to 45, with the ink tanks 41 to 45 arranged side by side in the leftward/rightward direction. As illustrated in FIG. 1, the ink supply tubes 46 routed from the rear of the ink tanks 41 to 45 respectively are connected to respective non-illustrated ink flow passages formed inside the carriage 26, and are connected to the recording head 25 via these respective ink flow passages. The ink refilling adapter 47 may be configured as a part of the housing 22 by which the ink tanks 41 to 45 are enclosed. The ink refilling adapter 47 may be formed integrally with the ink tanks 41 to 45.

Figure 4:
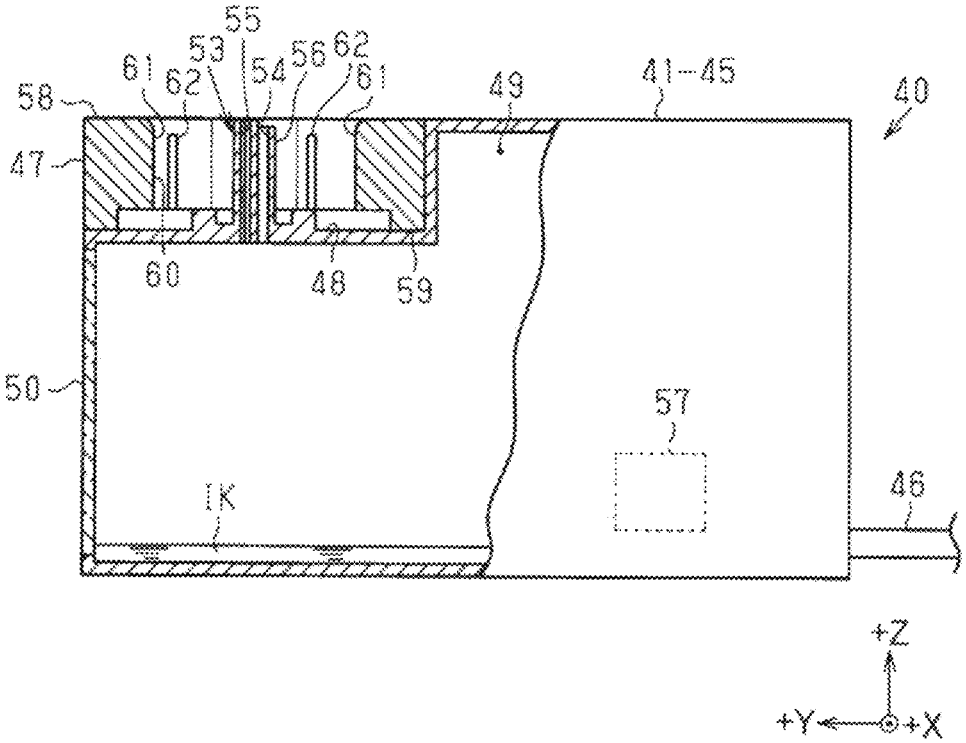
FIG. 4 is a partially-cut-away cross-sectional view taken along the line IV-IV of FIG. 3.
Figure 5:
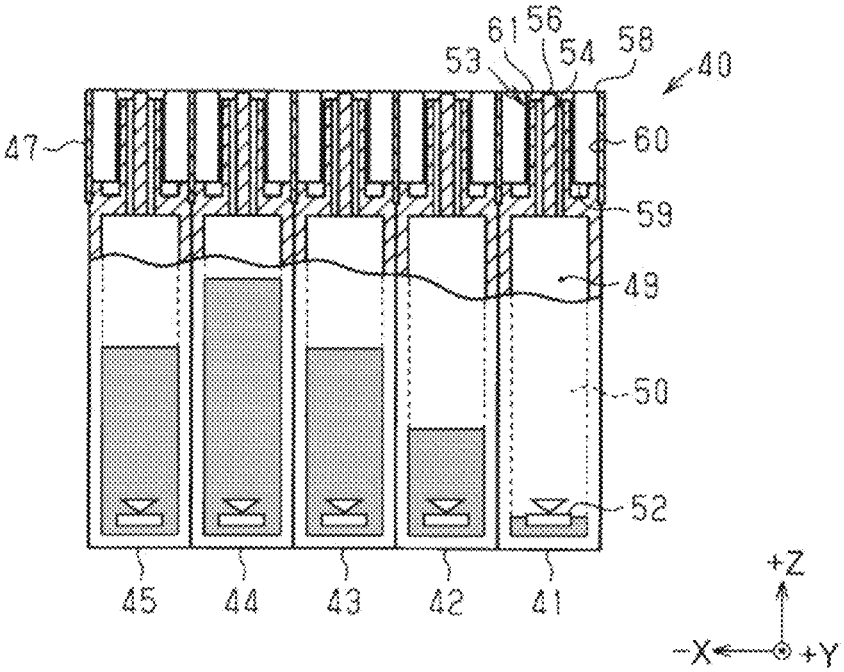
FIG. 5 is a partially-cut-away cross-sectional view taken along the line V-V of FIG. 3.

FIG. 4 is a partially-cut-away cross-sectional view taken along the line IV-IV of FIG. 3. FIG. 5 is a partially-cut-away cross-sectional view taken along the line V-V of FIG. 3. Each of the plurality of ink tanks 41 to 45 has an ink containing chamber 49 inside itself. The ink containing chamber 49 is a space inside which ink IK can be contained. In the present embodiment, black ink is contained in the ink containing chamber 49 of the ink tank 41, which is the rightmost one of the ink tanks arranged side by side. Ink of colors other than black, for example, cyan, magenta, and yellow, etc., is contained in the respective ink containing chambers 49 of the ink tanks 42 to 45, which are arranged side by side to the left of the rightmost one, that is, the ink tank 41. The front wall portion, which can be seen from the outside through the window portion 37 formed in the front face of the housing 22, of each of the plurality of ink tanks 41 to 45 has a see-through portion 50. The see-through portion 50 is made of a transparent resin so as to enable the liquid level of the ink IK contained in the ink containing chamber 49 to be seen. An upper limit mark 51, which approximately indicates the upper limit of the liquid level of the ink IK contained in the ink containing chamber 49, and a lower limit mark 52, which approximately indicates the lower limit thereof, are printed on the see-through portion 50. The limit indicated by the upper limit mark 51 roughly shows, for example, how much refill ink can be poured without causing any overflow from an ink inlet 53. The lower limit mark 52 roughly shows, for example, the level at which the user should refill the nearly empty ink tank with ink.

As illustrated in FIG. 4, the ink inlet 53, via which ink can flow into the ink containing chamber 49 from the outside, is provided over the horizontal part of the stepped portion 48 of each of the plurality of ink tanks 41 to 45. The ink inlet 53 includes a needle 56. The needle 56 has flow passages 54 and 55 and extends upright. The inside and the outside of the ink containing chamber 49 are in communication through the flow passages 54 and 55. The flow passages 54 and 55 of the needle 56 are two flow passages arranged adjacently such that their respective end openings are configured in radiating directions, with the center of the needle 56 located at the center of the radiating configuration. The flow passage 54, which is one of the two flow passages 54 and 55, is the rear-side flow passage in the present embodiment. The flow passage 55, which is the other, is the front-side flow passage in the present embodiment. In the present embodiment, the height of the rear-side flow passage 54 measured at its end opening is less than that of the front-side flow passage 55, and the cross-sectional area size of the rear-side flow passage 54 is larger than that of the front-side flow passage 55. A remaining amount sensor 57 for detecting the amount of the ink IK left in the ink containing chamber 49 is provided at a position closer to the rear near the bottom inside the ink containing chamber 49. The remaining amount sensor 57 may be omitted. The tip of the needle 56 may be configured as a level plane such that the flow passages 54 and 55 have an equal height. Further, the flow passages 54 and 55 may have the same cross-sectional area as each other.

As illustrated in FIGS. 2 to 5, the upper surface 58 of the ink refilling adapter 47 is a horizontal plane that intersects with, preferably, is orthogonal to, the direction in which the needle 56 extends. Through holes 60 going vertically down from the upper surface 58 to the lower surface 59 of the ink refilling adapter 47 are formed as an example of an ink inlet forming portion. The through hole 60 is made up of the ink inlet 53, which has a circular hole shape with the needle 56 arranged at its center, and front and rear rectangular hole portions constituting a pair, the front one of which is continuous from and is located in front of the ink inlet 53, and the rear one of which is continuous from and is located behind the ink inlet 53. The bottom-side opening of the ink refilling adapter 47 is closed by the horizontal part of the stepped portion 48, with the needle 56 protruding upright, in each of the plurality of ink tanks 41 to 45.

In the through hole 60, at areas located outside the ink inlet 53 in the radiating directions from the ink inlet 53, which lies at the center, front and rear recesses 61 which constitute a pair and have their respective openings open upward, that is, in the direction in which the needle 56 extends, are formed respectively, as defined by the above-mentioned front and rear rectangular hole portions which constitute the pair and whose bottom-side opening is closed. The recesses 61 are point-symmetric with respect to the ink inlet 53, the center of point symmetry. The depth direction of the recesses 61 goes vertically downward. That is, at the areas located outside the ink inlet 53 including the needle 56 in the ink refilling adapter 47 integrally attached to the ink tanks 41 to 45, the plurality of recesses 61, specifically, two recesses made up of the front one and the rear one constituting the pair in the present embodiment, are formed in a point-symmetric layout, with the ink inlet 53 located at the center of point symmetry. In this configuration, the tip of the needle 56 arranged at the center of the ink inlet 53 having a circular hole shape is located at a relatively-recessed position toward the ink containing chamber 49 in comparison with the upper surface 58 of the ink refilling adapter 47, at which the opening of the through hole 60, including the ink inlet 53 and including the recesses 61, is exposed. That is, the upper surface 58 of the ink refilling adapter 47 extends in the direction intersecting with the direction in which the needle 56 extends, at a height position that is more outside than the tip of the needle 56 as viewed in the direction in which the needle 56 extends. On the other hand, the lower surface 59 of the ink refilling adapter 47 serves as a tank engagement portion configured to be brought into engagement, from above, with the ink tanks 41 to 45 arranged side by side in the leftward/rightward direction by a single engaging operation all together.

A peripheral portion located around the upper edge of the opening of each of the plurality of through holes 60 in the upper surface 58 of the ink refilling adapter 47 is painted in a predetermined color, specifically, painted in the same color as that of ink having flowed in through the ink inlet 53 of the through hole 60 and contained in the ink containing chamber 49 of the ink tank 41 to 45. In this respect, the peripheral portion located around the upper edge of the opening of each of the plurality of through holes 60 of the ink refilling adapter 47 plays a role of a first portion that offers, to the outside, information about the ink contained inside the ink tank 41 to 45 in which the ink inlet 53 of the through hole 60 is in communication with the ink containing chamber 49. For example, black is the paint color of the peripheral portion located around the upper edge of the opening of the through hole 60 in which the ink inlet 53 that is in communication with the ink containing chamber 49 of the ink tank 41 containing black ink is arranged.

On the inner surface of the recess 61, specifically, on the inner side surface along the top/bottom direction, at a position that is closer to the bottom than the upper edge of the opening of the recess 61 is, that is, at a position that is closer to the horizontal part of the stepped portion 48, a first concave-and-convex portion 62 having a characteristic concave-and-convex shape in the horizontal direction is provided in such a way as to extend in the depth direction of the recess 61, or in other words, extend in the direction of the central axis of the ink inlet 53. Another name of the first concave-and-convex portion 62 is a first key structure portion. As illustrated in FIGS. 2 and 3, the first concave-and-convex portion 62 is provided individually for the ink inlet 53 of each of the plurality, five in the present embodiment, of ink tanks 41 to 45. Therefore, the first concave-and-convex portion 62 is formed in the rectangular recess 61 of each of the plurality of through holes 60 formed at positions corresponding to the ink tanks 41 to 45 respectively in the top/bottom direction in the ink refilling adapter 47, wherein the first concave-and-convex portion 62 formed in each one through hole 60 is different from the first concave-and-convex portion 62 provided on the inner surface of the recesses 61 of the other through holes 60. That is, each first concave-and-convex portion 62 of them serves as an identifier portion that makes it possible to identify an ink refilling container 63 that has an ink outlet 65 configured to be coupled to the ink inlet 53 of the through hole 60 in which this first concave-and-convex portion 62 is formed. In the description above, the "position that is closer to the bottom than the upper edge of the opening of the recess 61 is" means that any position suffices as long as it is set back toward the bottom, even if slightly, in comparison with the edge of the opening.

Figure 6:
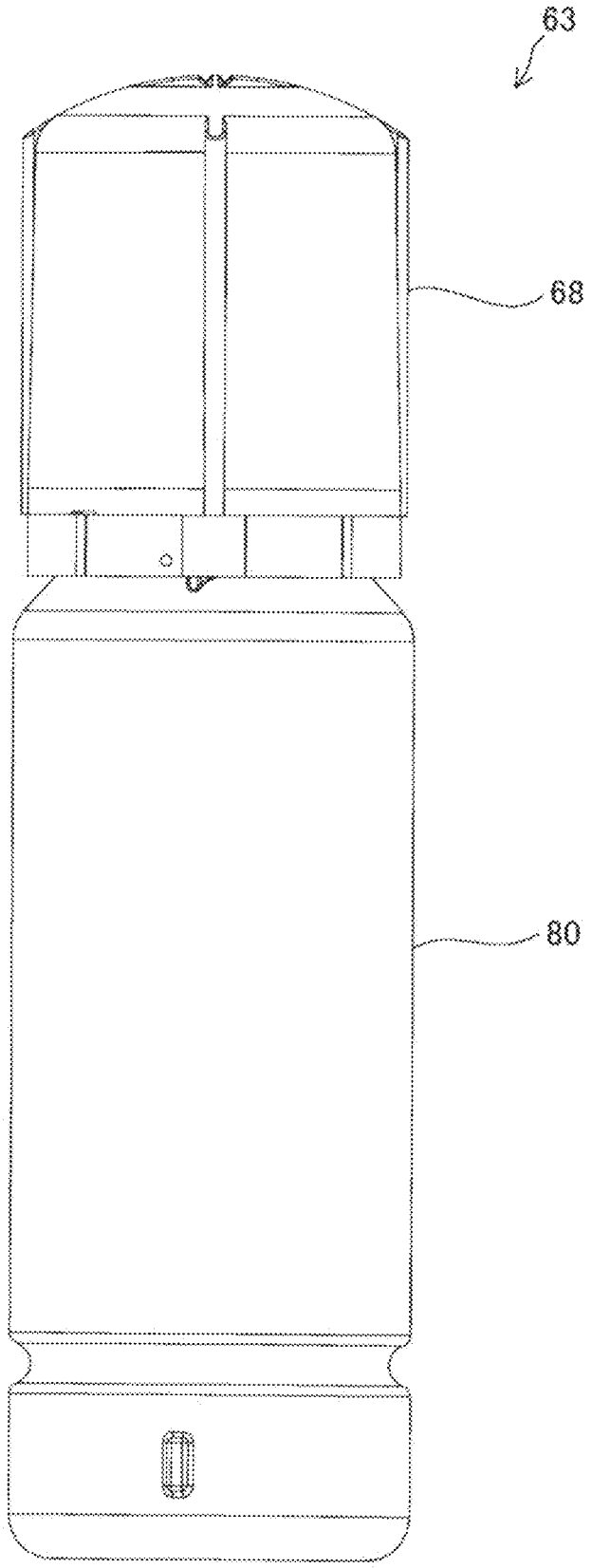
FIG. 6 is a side view of an ink refilling container.

FIG. 6 is a side view of the ink refilling container 63, with a cap 68 put thereon. The ink refilling container 63 and the ink tank 41 to 45 constitute an ink replenishment system. The ink refilling container 63 is a container from which refill ink is supplied to the ink tank 41 to 45 whose ink is running low. The ink refilling container 63 includes a bottle 80 and the cap 68. The cap 68 is configured to be put on the bottle 80 detachably. With regard to the ink refilling container 63, the bottom direction is defined as the direction from the cap 68 toward the bottle 80 when the ink refilling container 63 is placed on a table, etc., and the top direction is defined as the opposite direction, namely, from the bottle 80 toward the cap 68.

Figure 7:
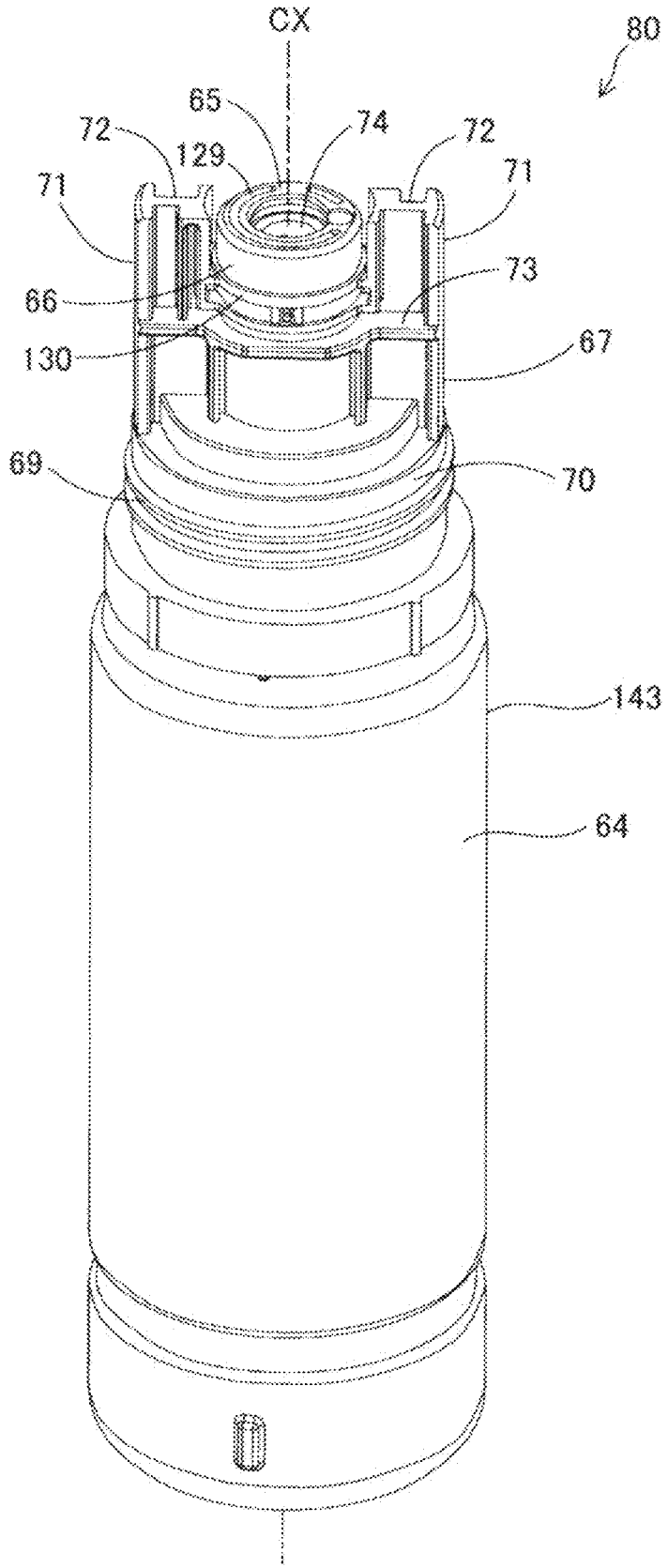
FIG. 7 is a perspective view of a bottle.
Figure 8:
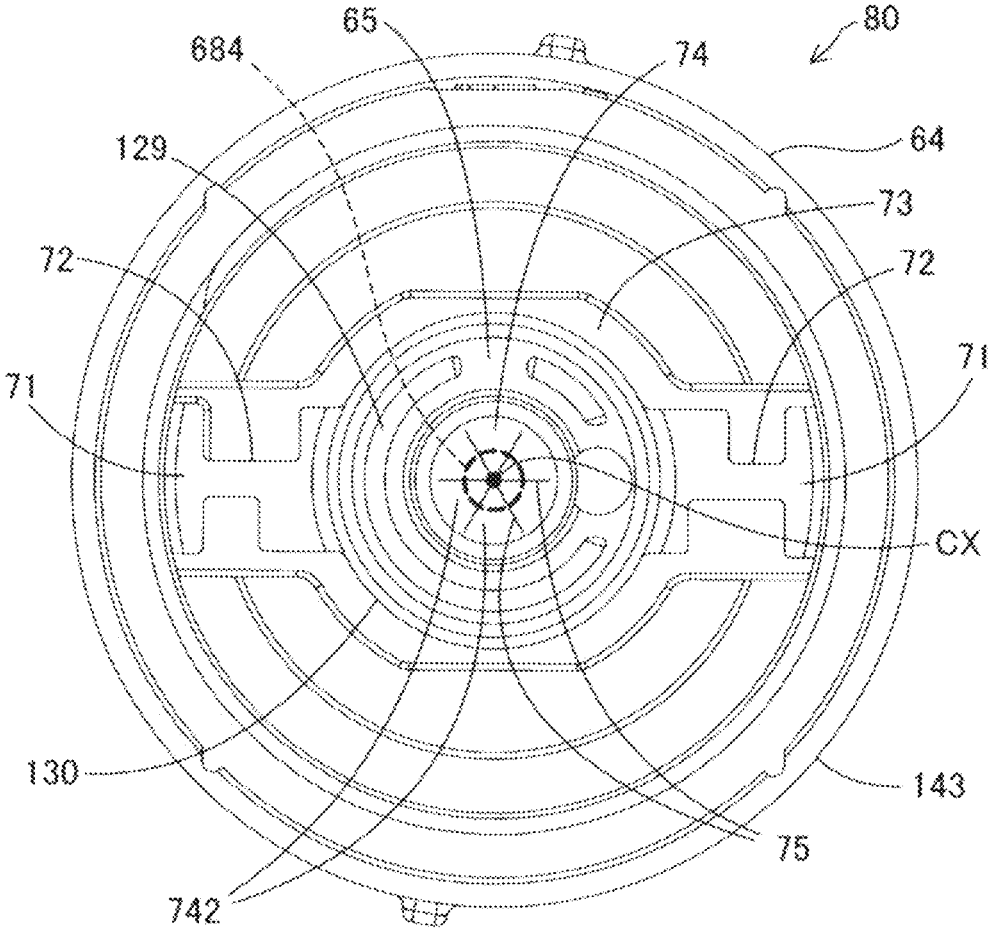
FIG. 8 is a plan view of the bottle.
Figure 9:
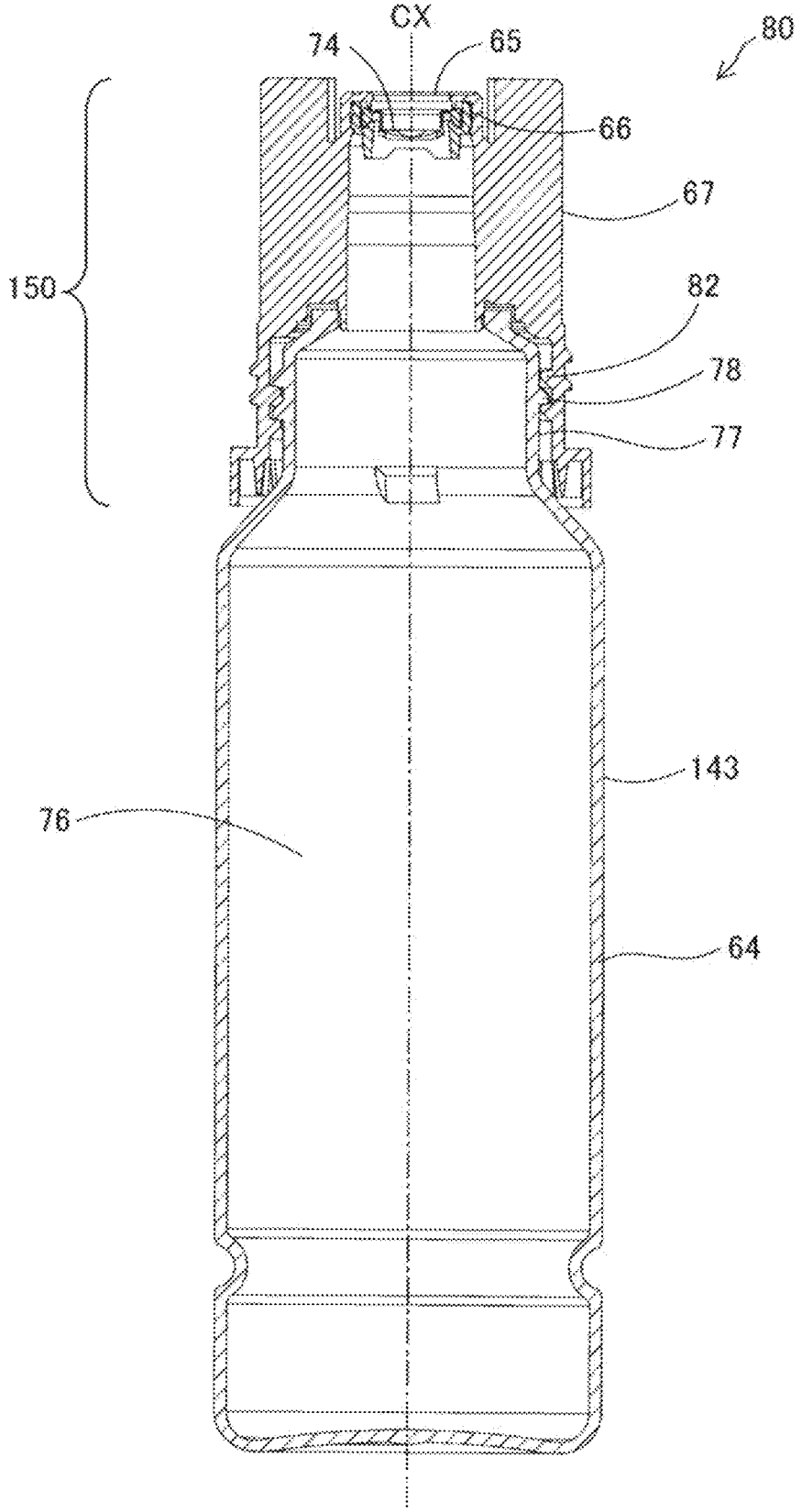
FIG. 9 is a longitudinal sectional view of the bottle.

FIG. 7 is a perspective view of the bottle 80. FIG. 8 is a plan view of the bottle 80. FIG. 9 is a longitudinal sectional view of the bottle 80. As illustrated in FIG. 7, the bottle 80 includes a container body portion 64, an ink outlet forming portion 66, and a container annexation portion 67. The container body portion 64 is a cylindrical portion having a bottom. This cylindrical portion with a bottom is the main part of the bottle 80. As illustrated in FIG. 9, the container body portion 64 has an ink containing portion 76, inside which ink can be contained. The ink outlet forming portion 66 is provided at the top-side end of the container body portion 64, the opposite of the bottom of the container body portion 64. The ink outlet forming portion 66 is a portion where the ink outlet 65 is formed as an opening at its end. Ink is able to flow out through the ink outlet 65 from the inside of the ink refilling container 63. The container annexation portion 67 is a portion annexed to the ink outlet forming portion 66 in such a way as to interpose at least a part of the ink outlet 65. In the present embodiment, the ink outlet forming portion 66 and the container annexation portion 67 are formed integrally. That is, the container annexation portion 67 is a part of the ink outlet forming portion 66. Among components that constitute the ink refilling container 63, at least the container body portion 64 is made of a transparent or semitransparent material. As such a material, for example, polypropylene can be used. The ink outlet forming portion 66 and the container annexation portion 67 may be configured as distinct parts that are not formed integrally.

The ink outlet 65 is in communication with the ink containing portion 76 illustrated in FIG. 9. As illustrated in FIG. 8, in the present embodiment, a groove 129 is formed in the end face of the ink outlet 65. In addition, as illustrated in FIG. 7, an annular convex portion 130 is formed along the outer circumference of the ink outlet forming portion 66 at a position between the end of the ink outlet 65 and a positioning portion 73. The positioning portion 73 will be described later. Since the groove 129 is provided, it is possible to reduce the risk of dripping of ink from the ink outlet 65 when the ink refilling container 63 is put into an upright position after the ink tank 41 to 45 is refilled with ink. Moreover, since the annular convex portion 130 is provided, even if ink drips down from the ink outlet 65, it is possible to stem the dripping ink.

As illustrated in FIG. 7, the ink outlet forming portion 66 and the container annexation portion 67 are provided above the container body portion 64. The ink outlet 65 formed by the ink outlet forming portion 66, together with the container annexation portion 67 annexed around it, is covered by the cap 68 and therefore cannot be seen from the outside when the ink refilling container 63 is in a storage state. A first thread portion 69 is formed on the outer circumferential portion 70 of a cylindrical lower-end part of the ink outlet forming portion 66.

Figure 10:
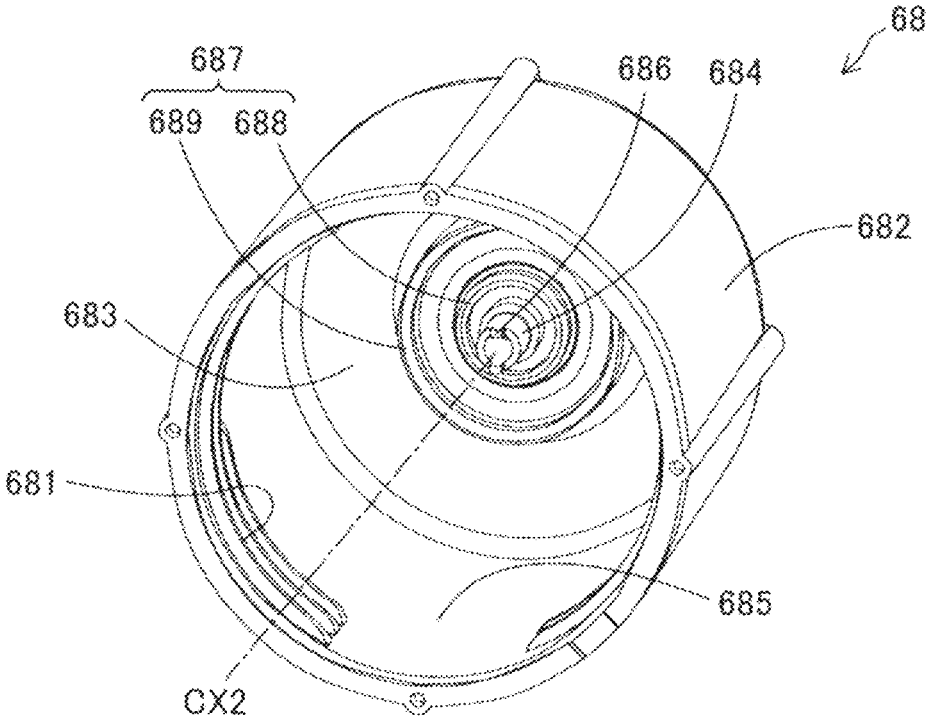
FIG. 10 is a perspective view showing an inner shape of a cap.

FIG. 10 is a perspective view showing an inner shape of the cap 68. A second thread portion 681 is formed on the inner circumferential surface of the cap 68. The second thread portion 681 formed in the cap 68 is configured to be brought into thread engagement with the first thread portion 69 of the bottle 80. By this thread engagement, the cap 68 is attached onto the bottle 80 in such a way as to enclose the ink outlet 65 at the mouth portion of the ink refilling container 63. A state in which the cap 68 is attached to the bottle 80 by the thread engagement of the first thread portion 69 of the bottle 80 and the second thread portion 681 of the cap 68 will be hereinafter referred to as "cap-on state".

As illustrated in FIG. 10, the cap 68 includes a barrel portion 682, a top portion 683, and a protruding portion 684.

The barrel portion 682 has a cylindrical shape. The barrel portion 682 includes an inner circumferential portion 685 on which the second thread portion 681 configured to engage with the first thread portion 69 is formed. On the inner circumferential portion 685, the second thread portion 681 is formed near an opening-side end that is the opposite of a top-end end located closer to the top portion 683.

In a cap-on state, the top portion 683 faces the ink outlet 65 of the bottle 80. The top portion 683 is provided on the barrel portion 682 in such a way as to close the top of the barrel portion 682.

The protruding portion 684 is provided at the center of the inner surface of the top portion 683. In the present embodiment, the protruding portion 684 has a substantially cylindrical shape. The protruding portion 684 extends in the direction of the central axis CX2 of the barrel portion 682. In addition, in a cap-on state, the protruding portion 684 extends in the direction of the central axis CX of the ink outlet 65. This means that, in a cap-on state, the central axis CX of the ink outlet 65 of the bottle 80 is in alignment with the central axis CX2 of the barrel portion 682 of the cap 68. As illustrated in FIG. 8, the radius of the protruding portion 684 is set to be less than the length of each slit 75 formed in a valve 74 provided inside the ink outlet 65. More specifically, the radius of the protruding portion 684 is set to be less than the length of the slit 75 as viewed in the direction of the central axis CX of the ink outlet 65 when the valve 74 is closed. The valve 74 and the slits 75 will be described in detail later.

Small protrusions 686 are provided at the tip end of the protruding portion 684. In the present embodiment, the small protrusions 686 are provided as a part of the protruding portion 684 and constitute the tip end of the protruding portion 684. The small protrusions 686 protrude in the direction of the central axis CX2 of the barrel portion 682. In addition, in a cap-on state, the small protrusions 686 protrude in the direction of the central axis CX of the ink outlet 65. It is preferable if the protruding portion 684 has a plurality of small protrusions 686. It is more preferable if the number of the small protrusions 686 which the protruding portion 684 has is less than the number of the valve segments 742 provided in the valve 74. In the present embodiment, the number of the valve segments 742 is six, and the number of the small protrusions 686 is two. The small protrusions 686 are provided at equal intervals in the circumferential direction along the outer circumference of the protruding portion 684. The small protrusions 686 can be described as having a structure formed by cutting away some parts of a ring wall, which would be annularly continuous if no part were cut away, of the protruding portion 684 having a cylindrical shape.

Figure 14:
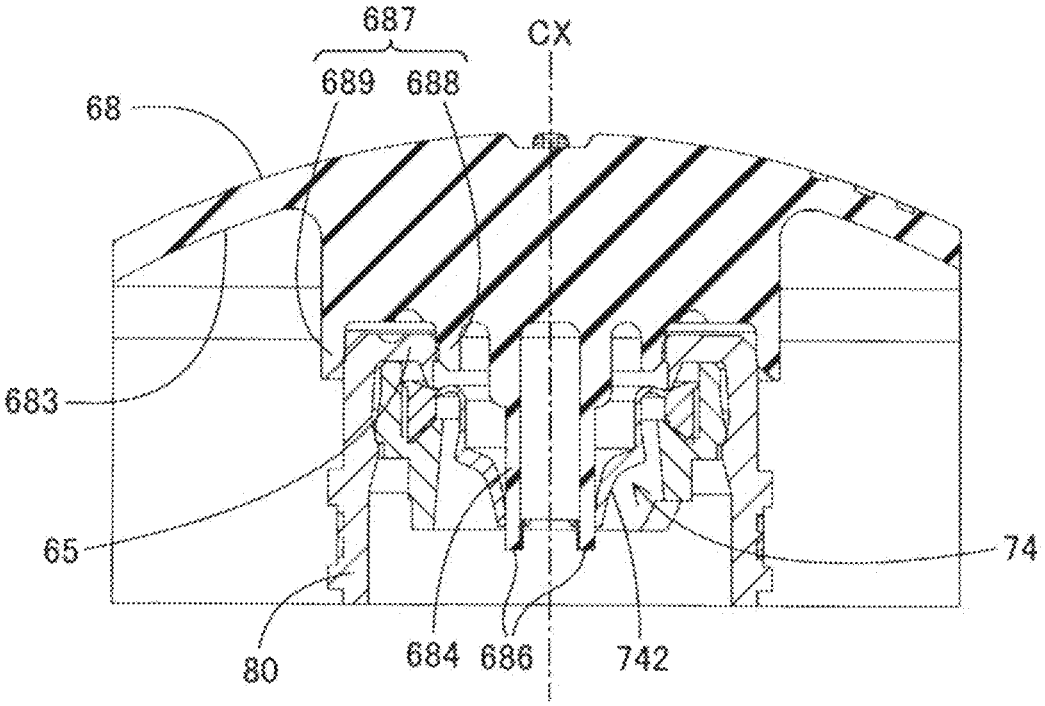
FIG. 14 is a cross-sectional view showing a positional relationship between a protruding portion and a valve.

An annular sealing portion 687 is provided on the top portion 683 outside the protruding portion 684 in the radial direction. In a cap-on state, the sealing portion 687 seals the ink outlet 65 tightly. In the present embodiment, the sealing portion 687 includes a first sealing portion 688 and a second sealing portion 689. The second sealing portion 689 is located at an outer position relative to the first sealing portion 688. As illustrated in FIG. 14, in a cap-on state, the outer circumferential surface of the first sealing portion 688 is in contact with the inner circumferential surface of the ink outlet 65 to seal the ink outlet 65 tightly. In addition, in a cap-on state, the inner circumferential surface of the second sealing portion 689 is in contact with the outer circumferential surface of the ink outlet 65 to seal the ink outlet 65 tightly. That is, in the present embodiment, the ink outlet 65 is sealed tightly by both of the first sealing portion 688 and the second sealing portion 689. Instead of providing both of the first sealing portion 688 and the second sealing portion 689, either one of them may be provided, and the ink outlet 65 may be sealed tightly by the one provided.

In the present embodiment, in a cap-on state, the protruding portion 684 provided on the cap 68 is inserted into the bottle 80 through the slits 75 formed in the valve 74. In a state in which the protruding portion 684 is inserted through the valve 74, the gap between each valve segment 742 and the protruding portion 684 is very small. For this reason, even if the ink refilling container 63 is turned upside down, the leakage of ink from the bottle 80 into the cap 68 does not occur easily because an ink meniscus is formed at the gap between the valve segment 742 and the protruding portion 684. A detailed explanation of a positional relationship between the protruding portion 684 and the valve 74 in a cap-on state will be given later.

The whole of the outer surface of the container annexation portion 67 illustrated in FIGS. 7 to 9 is painted in a predetermined color. Specifically, it is painted in the same color as that of ink contained in the container body portion 64 to which the container annexation portion 67 is annexed. In this respect, the container annexation portion 67 of the ink refilling container 63 plays a role of a second portion that offers, to the outside, information about the ink contained inside the ink refilling container 63. For example, the outer surface of the container annexation portion 67 of the ink refilling container 63 containing black ink is painted in black. It is not always necessary for the container annexation portion 67 to be painted in the same color as that of the ink, and the container annexation portion 67 may be made of a transparent or semitransparent material. The ink outlet forming portion 66 may be made of a transparent or semitransparent material. If the ink outlet forming portion 66 is made of a transparent or semitransparent material, it becomes easier to recognize the color of ink adhering to the inside of the ink outlet 65 when seen from the outside. Moreover, for example, the container body portion 64 of the ink refilling container 63 containing black ink may be configured to be thicker than the container body portion 64 of the ink refilling container 63 containing ink of any other color. In this configuration, the thickness and shape of the ink outlet forming portion 66 for black ink may be configured to be the same as the thickness and shape of the ink outlet forming portion 66 for any other color.

As illustrated in FIG. 7, a convex portion 71 is provided on at least a part of periphery around the ink outlet 65, wherein the convex portion 71 is configured to fit into the recessed portion 61 provided for each of the plurality of ink tanks 41 to 45 to which refill ink is supplied. More specifically, the convex portion 71 is formed above the cylindrical lower-end part on which the first thread portion 69 is formed on the outer circumferential surface of the container annexation portion 67 at areas located outside the ink outlet 65 in the radiating directions from the ink outlet 65, which lies at the center, in such a way as to protrude upward in the direction of the central axis CX of the ink outlet 65. The convex portion 71 serves as a second mating portion that is able to mate with a first mating portion, specifically, mate with the recessed portion 61 formed in the upper surface 58 of the ink refilling adapter 47, when the tip of the needle 56 of the ink inlet 53 is inserted into the ink outlet 65. Similarly to the pair of recesses 61 made up of the front one and the rear one between which the ink inlet 53 is located, the convex portion 71 is configured as a pair made up of the front one and the rear one between which the ink outlet 65 is located. As illustrated in FIG. 8, the convex portion 71 is located at an inner position relative to the external wall 143 of the container body portion 64 in the radiating directions from the ink outlet 65, which lies at the center, in the ink refilling container 63.

In the present embodiment, the tip end of the convex portion 71 of the ink refilling container 63 protrudes beyond the ink outlet 65 in the direction of the central axis CX of the ink outlet 65. For this reason, it is possible to prevent the risk of staining the user's finger(s) and/or the peripheral portion of the ink refilling container 63 with ink due to the touch contact of the ink outlet 65 with it during an ink refilling process. In another embodiment, the tip end of the convex portion 71 may be configured not to protrude beyond the ink outlet 65 in the direction of the central axis CX of the ink outlet 65.

A second concave-and-convex portion 72, which is able to be brought into engagement with the first concave-and-convex portion 62 formed on the inner surface of the corresponding recessed portion 61 of the ink refilling adapter 47, is formed in the outer surface of each convex portion 71 in the leftward/rightward direction. Another name of the second concave-and-convex portion 72 is a second key structure portion. The second concave-and-convex portion 72 extends in the direction in which the convex portion 71 protrudes. In other words, the second concave-and-convex portion 72 extends in the direction of the central axis CX of the ink outlet 65. When the convex portion 71 mates with the recessed portion 61, accompanied by engagement of the second concave-and-convex portion 72 with the first concave-and-convex portion 62, the ink outlet 65 of the ink refilling container 63 is coupled to the ink inlet 53 for the ink tank 41 to 45. The convex portion 71, including the second concave-and-convex portion 72, is provided in a point-symmetric layout, with the ink outlet 65 located at the center of point symmetry. In the present embodiment, the pair constituting the convex portion 71 is arranged with 180° point symmetry. Therefore, when one of the pair constituting the convex portion 71 is positioned to face one of the pair constituting the recessed portion 61, the other of the pair constituting the convex portion 71 will inevitably face the other of the pair constituting the recessed portion 61. This structure makes mating and engagement easier.

Between the cylindrical lower-end part, of the container annexation portion 67, on which the first thread portion 69 is formed and the convex portion 71 in which the second concave-and-convex portion 72 is formed, as illustrated in FIG. 8, the positioning portion 73 that has a plane shape intersecting with, or preferably orthogonal to, the central axis CX of the ink outlet 65 is provided outside the ink outlet 65 in the radiating directions when viewed in the direction of the central axis CX of the ink outlet 65. Moreover, the positioning portion 73 is provided so as to sandwich the ink outlet 65 and the convex portion 71 in directions of +X and −X when the convex portion 71 is positioned in +Y and −Y directions. The positioning portion 73 constitutes a part of the exterior face of the container annexation portion 67 that is a part of the exterior face of the ink refilling container 63. As illustrated in FIG. 7, the positioning portion 73 is provided at a position closer to the container body portion 64 than the tip end of the convex portion 71 is, as viewed in the direction of the central axis CX of the ink outlet 65.

As illustrated in FIG. 9, the bottle 80 is configured by assembling a spout portion 150, the valve 74, and the container body portion 64 together. The spout portion 150 is integrally made up of the ink outlet 65, the ink outlet forming portion 66, and the container annexation portion 67.

A third thread portion 78 is formed on the outer circumferential surface of a neck portion 77, which is provided at the upper end of the container body portion 64. On the other hand, a fourth thread portion 82 is formed on the inner circumferential surface of the lower portion of the spout portion 150. By thread engagement of the fourth thread portion 82 with the third thread portion 78 formed on the neck portion 77 of the container body portion 64, the spout portion 150 is attached onto the upper portion of the container body portion 64.

The valve 74 made of an elastic material, for example, a silicon membrane, for sealing the ink outlet 65 in such a way that the ink outlet 65 can be opened and closed is provided inside the ink outlet 65 formed in the ink outlet forming portion 66. As illustrated in FIG. 7, the valve 74 is provided at a position closer to the mouth end than the positioning portion 73 is, as viewed in the direction of the central axis CX of the ink outlet 65.

As illustrated in FIG. 8, the valve 74 includes the valve segments 742 segmented by at least one slit 75 extending in the radial direction from the center of the ink outlet 65 toward the outer circumference. In the present embodiment, six slits 75 are provided. Therefore, the number of the valve segments 742 is six. These valve segments 742 are pushed by the needle 56 to give way in a widening manner into the inside of the ink outlet 65 from the outside, and the valve 74 is configured to open in this way. The valve 74 is called also as a slit valve. When the needle 56 is removed from the ink outlet 65, the valve 74 returns to its original state due to its elastic resilience and thus closes, with the gap of the slits 75 made narrower than in a valve-open state.

When the valve 74 opens due to the insertion of the tip of the needle 56 of the ink inlet 53 into the ink outlet 65, the positioning portion 73 is placed in contact with the upper surface 58 of the ink refilling adapter 47, in which the through holes 60 including the ink inlets 53 and the recesses 61 are formed, thereby positioning the valve 74 relative to the ink tank 41 to 45 in the direction of the central axis CX of the ink outlet 65. In this respect, the upper surface 58 of the ink refilling adapter 47 serves as a receiving surface constituting a part of the ink-tank-side structure with which the positioning portion 73 of the ink refilling container 63 is placed in contact and configured to receive the positioning portion 73 having a plane shape when the valve 74 of the ink outlet 65 of the ink refilling container 63 opens for the purpose of allowing the supply of refill ink to the ink tank 41 to 45.

Figure 11:
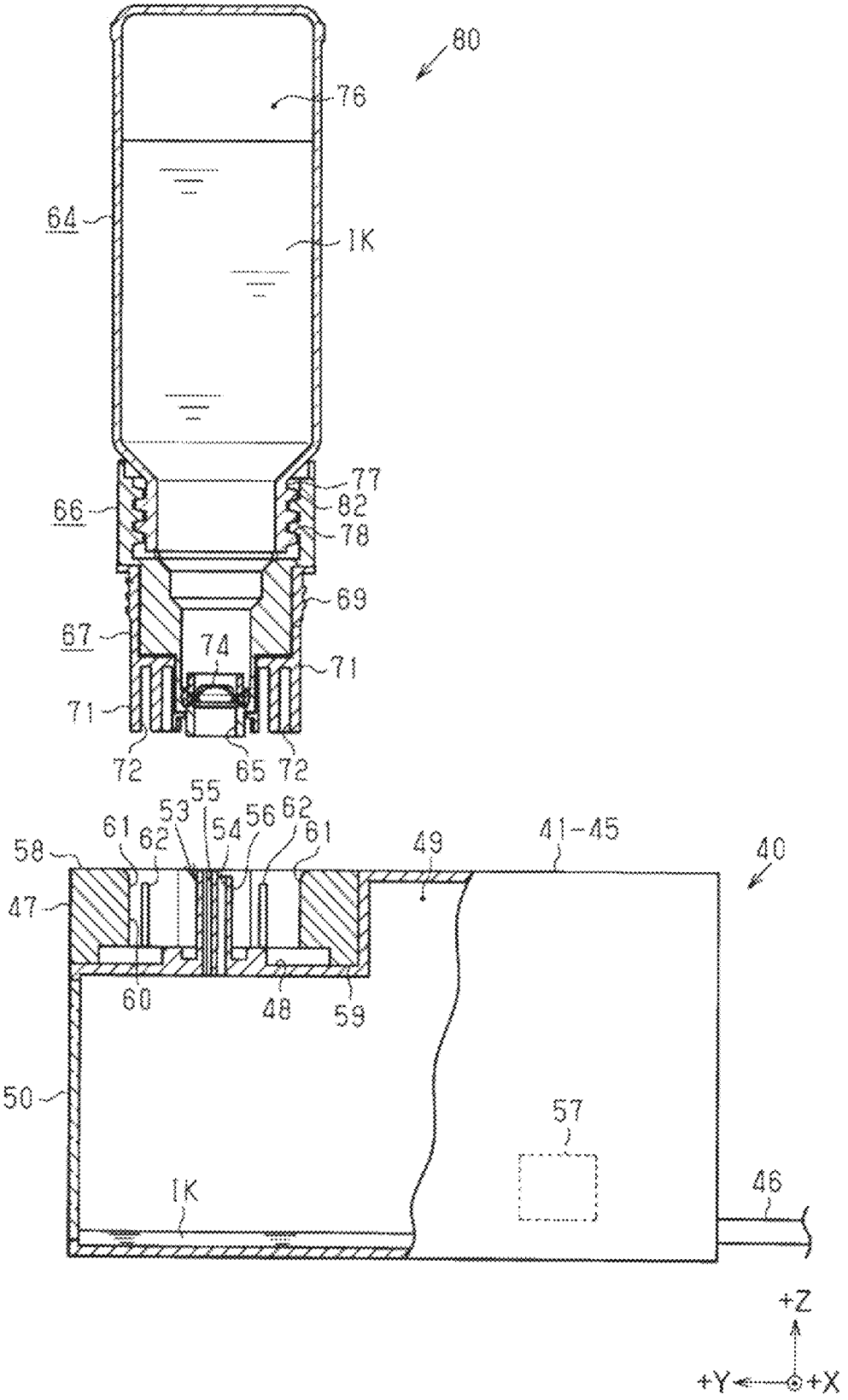
FIG. 11 is a partially-cut-away side view showing a state immediately before ink refilling is performed.
Figure 12:
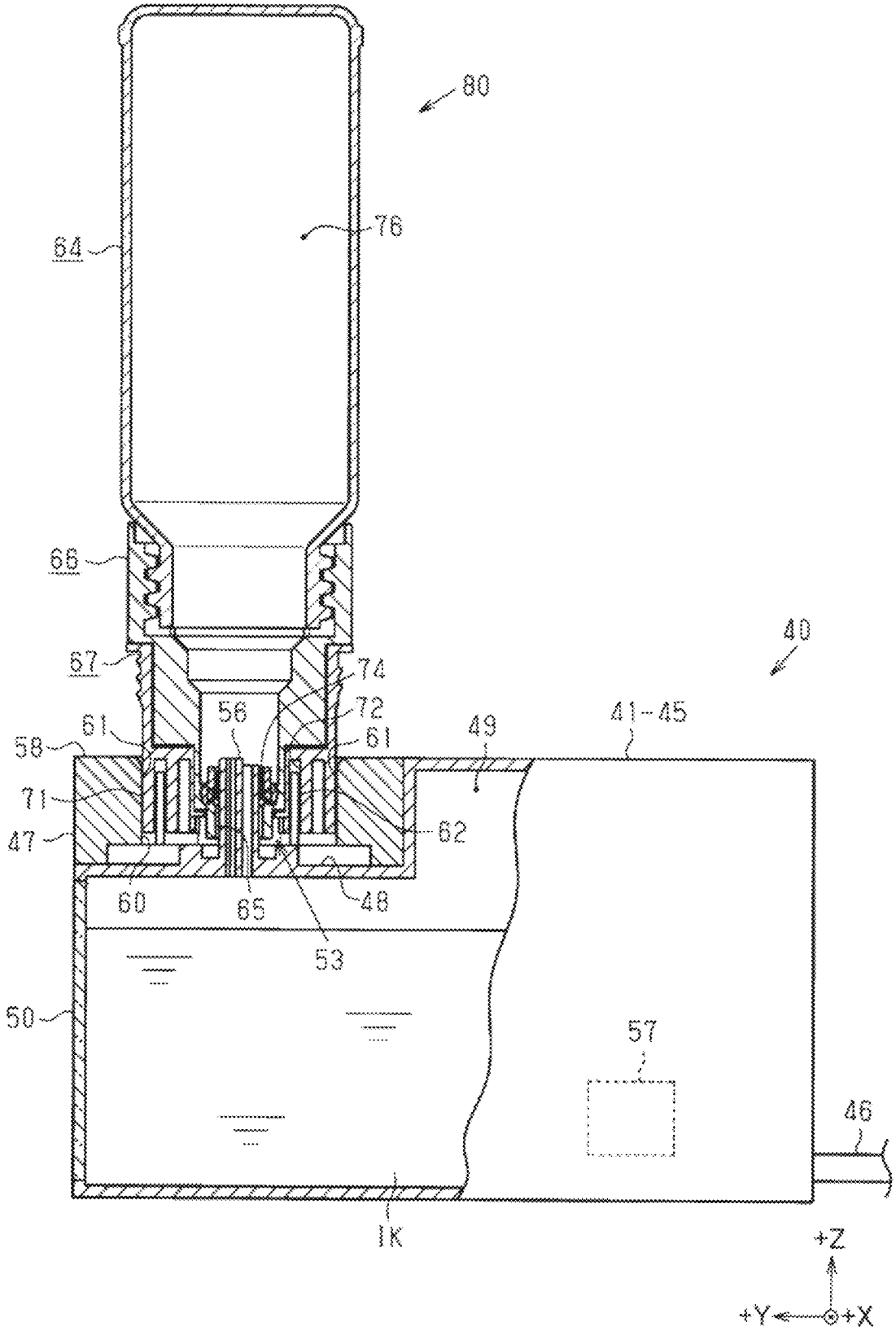
FIG. 12 is a partially-cut-away side view showing a state during ink refilling.
Figure 13:
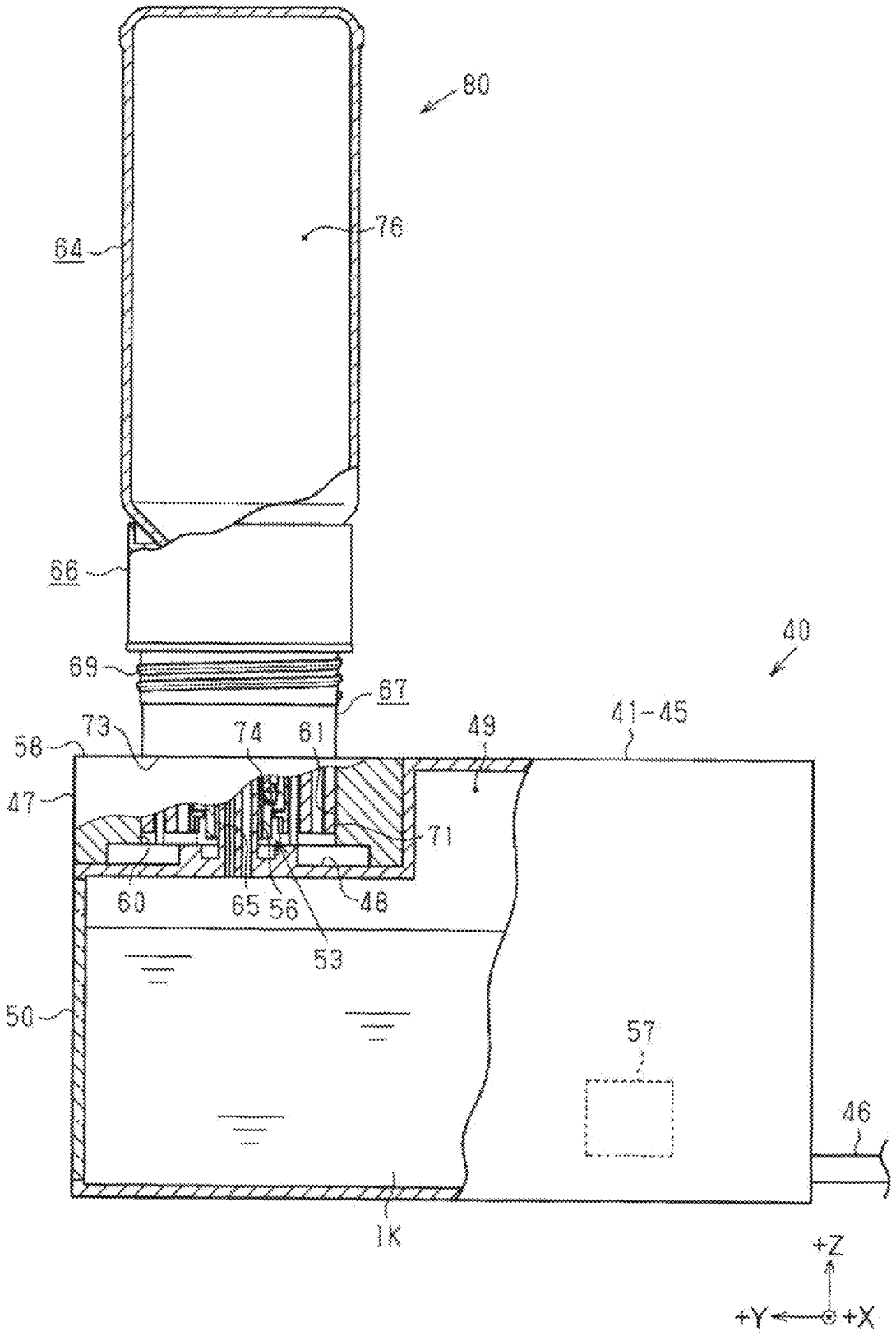
FIG. 13 is a partially-cut-away side view showing a state in which a positioning portion is placed in contact with an ink-tank-side receiving surface.

FIG. 11 is a partially-cut-away side view showing a state of an ink replenishment system immediately before ink refilling is performed. FIG. 12 is a partially-cut-away side view showing a state during ink refilling. FIG. 13 is a partially-cut-away side view showing a state in which the positioning portion of the ink refilling container is placed in contact with the ink-tank-side receiving surface. The operational behavior of an ink replenishment system having the structure described above will now be explained, with a focus on operation in refilling the ink tank 41 to 45 of the ink supply unit 40 with ink by using the ink refilling container 63. As a premise of the description below, as illustrated in FIG. 2, it is assumed here that the level of ink contained in the ink tank 41 corresponding to black ink and located at the rightmost position among the plurality of ink tanks 41 to 45 arranged side by side has become low to reach the lower limit mark 52 printed at the lowest part of the see-through portion 50. Therefore, in the description below, it is assumed that there is a need to refill the ink tank 41 with ink. It is further assumed that the ink refilling container 63 used for ink refilling contains a sufficient amount of black ink, and the cap 68 has been removed in advance from the ink refilling container 63. It is further assumed that the shape of the second concave-and-convex portion 72 formed in the outer surface of the convex portion 71 of the ink refilling container 63 matches the shape of the first concave-and-convex portion 62 formed on the inner surface of the recessed portion 61 located in front of and behind the ink inlet 53 toward the ink tank 41, and, because of the matching shape, the second concave-and-convex portion 72 is able to come into engagement with the first concave-and-convex portion 62 when the convex portion 71 is inserted into the recessed portion 61. In FIGS. 11, 12, and 13, the ink outlet 65 is illustrated as if it protrudes beyond the convex portion 71 for the sake of illustrative convenience. However, the operational behavior of an ink replenishment system described below will be the same even if the convex portion 71 protrudes beyond the ink outlet 65.

To refill the ink tank 41 with ink, first, the user opens the openable-and-closable door 35 of the housing 22 by rotating it frontward around the pivot 36 from a closed state illustrated in FIG. 1. As a result, the upper surface 58 of the ink refilling adapter 47, in which the ink inlets 53 communicating to the ink tanks 41 to 45 respectively are formed, of the ink supply unit 40 becomes exposed to the outside of the housing 22. In this top-exposed state, the user is able to couple the ink outlet 65 of the bottle 80 from above to the target ink inlet 53, which is the one corresponding to the ink tank which the user wants to refill.

Then, as illustrated in FIG. 11, the user turns the bottle 80 containing black ink to be used for refilling upside down, and holds it such that the ink outlet 65 is positioned over the rightmost one of the through holes 60 of the ink refilling adapter 47. That is, the user positions the central axis CX of the ink outlet 65 of the bottle 80 in alignment with the central axis of the ink inlet 53 for the ink tank 41, namely, the one which the user wants to refill. When the user performs this positioning, the user visually checks the paint color of the container annexation portion 67 of the bottle 80 held in the user's hand against the paint color of the periphery around the upper edge of the opening of the through hole 60 in which the ink inlet 53 for the ink tank 41, namely, the one which the user wants to refill, is provided. If the colors of the two match, the user is able to confirm that the bottle 80 held in the user's hand is suitable one for the current ink refilling. After the confirmation, the user proceeds to the next step.

Next, the user lowers the bottle 80 from the state illustrated in FIG. 11 to insert the convex portion 71 of the bottle 80 into the recessed portion 61 of the ink refilling adapter 47 integrally attached to the ink tank 41. The insertion of the convex portion 71 into the recessed portion 61 ensures that the central axis of the ink outlet 65 is in alignment with the central axis of the ink inlet 53. Since the pair constituting the recessed portion 61 is point symmetric with respect to the needle 56 located at the center of the ink inlet 53, the convex portion 71 is able to be inserted into whichever one of the recessed portion 61. Therefore, there is no need for the user to confirm whether the recessed portion 61 and the convex portion 71 are in a suitable positional relationship or not by rotating the bottle 80 around the central axis CX of the ink outlet 65 again and again. The user is able to insert the convex portion 71 into the recessed portion 61 easily.

In the process of inserting the convex portion 71 into the recessed portion 61 downward, which is the depth direction of the recessed portion 61, from a state in which the convex portion 71 is slightly inserted in the recessed portion 61, the second concave-and-convex portion 72 formed in the outer surface of the convex portion 71 comes into engagement with the first concave-and-convex portion 62 formed on the inner surface of the recessed portion 61. Then, when the user further inserts the convex portion 71 into the recessed portion 61 toward the bottom, that is, in the depth direction of the recessed portion 61, while keeping the engaged state, the tip of the needle 56 of the ink inlet 53 reaches the position of the valve 74 of the ink outlet 65 and causes the valve 74 to open.

That is, as illustrated in FIG. 12, the tip of the needle 56 pushes the valve 74 to widen the slits 75 upward from below, or in other words, from the outside to the inside of the ink outlet 65, thereby putting the valve 74 into an open state. As a result, the ink outlet 65 of the bottle 80 becomes coupled to the needle 56 of the ink inlet 53 for the ink tank 41, and black ink for a refill is supplied from the inside of the bottle 80 into the ink tank 41. When this refilling is performed, one of the two flow passages 54 and 55 of the needle 56 of the ink inlet 53 serves as an ink flow passage, through which the ink flows, and the other serves as an air flow passage, through which air flows. Specifically, of the two flow passages 54 and 55, the one whose end opening comes into contact earlier than the other with the ink that has flowed out from the ink outlet 65 by opening the valve 74 serves as the ink flow passage, and the other serves as the air flow passage. For example, if the user attempts to couple the ink outlet 65 to the ink inlet 53 with the bottle 80 tilted, which one of the two flow passages 54 and 55 serves as the ink flow passage depends on which direction the bottle 80 is tilted in.

If the second concave-and-convex portion 72 does not come into engagement with the first concave-and-convex portion 62 after starting the insertion of the convex portion 71 into the recessed portion 61, the user is able to know at that point in time that the user is mistakenly attempting to attach a wrong bottle 80 corresponding to a color other than black. In such a case of wrong bottle attachment, if the upper end of the first concave-and-convex portion 62 were located at the same height level as the edge of the opening of the recessed portion 61, not only the engagement of the second concave-and-convex portion 72 with the first concave-and-convex portion 62 but also the insertion of the convex portion 71 into the recessed portion 61 would be impossible. Therefore, the user might spend fruitless time trying to insert the convex portion 71 into the recessed portion 61 again and again in vain. In this respect, in the present embodiment, since the upper end of the first concave-and-convex portion 62 is located below the edge of the opening of the recessed portion 61, when the convex portion 71 is inserted into the recessed portion 61, it is easier for the convex portion 71 to be guided toward the bottom in the depth direction of the recessed portion 61. Moreover, the user will not spend time in a vain attempt.

Moreover, as illustrated in FIGS. 12 and 13, when the needle 56 of the ink inlet 53 for the ink tank 41 opens the valve 74 provided inside the ink outlet 65 of the bottle 80, the positioning portion 73 of the bottle 80 is placed in contact with the upper surface 58 of the ink refilling adapter 47 constituting a part of the ink-tank-side structure. That is, the bottle 80 is held such that the valve 74 is opened in a state of being positioned with respect to the needle 56, which is provided on the side where the ink tank 41 is provided, in the direction of the central axis of the ink outlet 65 due to the contact of the positioning portion 73 with the upper surface 58 of the ink refilling adapter 47.

Moreover, in this process, the bottle 80 is held stably with good coupling of the ink outlet 65 to the ink inlet 53 because the positioning portion 73 is provided outside the ink outlet 65 in the radiating directions. Furthermore, when the positioning portion 73 of the bottle 80 is placed in contact with the upper surface 58 of the ink refilling adapter 47, there is a gap between the bottom-side surface of the ink inlet 53 at which the base end of the needle 56 of the ink inlet 53 is located and the end of the ink outlet 65 of the bottle 80. Therefore, ink is prone to form a pool on the bottom-side surface of the ink inlet 53 at which the base end of the needle 56 of the ink inlet 53 is located; however, the disclosed structure makes it possible to prevent the bottle 80 from being stained due to the contact of such a pool of ink with the end of the ink outlet 65.

If the level of ink contained in the ink tank 41 is still lower than the upper limit mark 51 of the see-through portion 50 when the refilling of the ink tank 41 with ink from the bottle 80 has finished, the ink tank 41 may be further refilled up to the level of the upper limit mark 51 by using another bottle 80 containing ink of the same color, that is, black. The ink refilling described above can be performed for the ink tanks 42 to 45 corresponding to ink of colors other than black in the same manner as done for the ink tank 41 corresponding to black ink.

Figure 15:
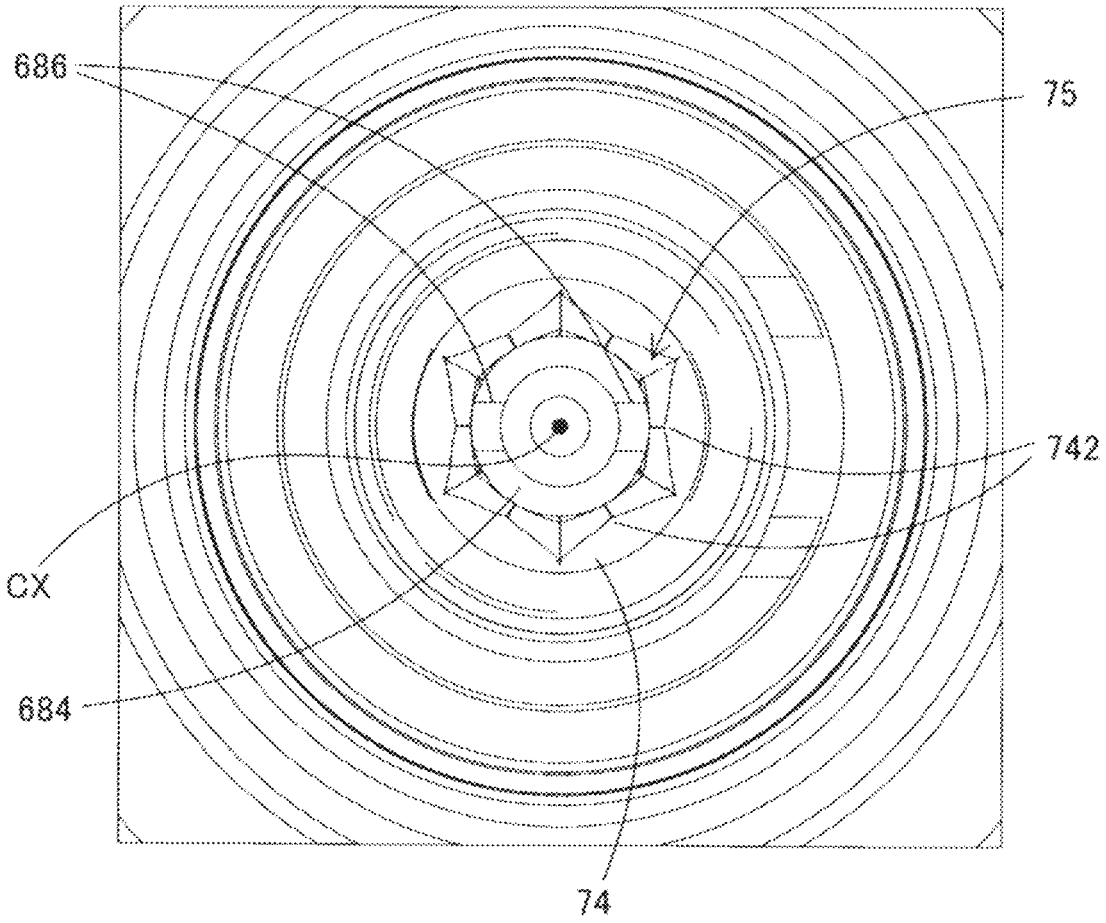
FIG. 15 is a view of the positional relationship between the protruding portion and the valve, seen from the inside of a spout portion.

FIG. 14 is a cross-sectional view showing a positional relationship between the protruding portion 684 and the valve 74 in a cap-on state. FIG. 15 is a view of the positional relationship between the protruding portion 684 and the valve 74 in a cap-on state, seen from the inside of the spout portion 150. As illustrated in these drawings, in a cap-on state, that is, in a sealed state in which the cap 68 is in thread engagement with the bottle 80 and in which the sealing portion 687 seals the ink outlet 65 tightly, the protruding portion 684 is inserted in the inside of the bottle 80 through the slits 75 at the center region as viewed in the direction of the central axis CX of the ink outlet 65. This means that, in a cap-on state, the protruding portion 684 is inserted into the slits 75 to protrude through the valve 74 downward in the direction of the central axis CX. Therefore, in a cap-on state, the tip end of the protruding portion 684 protrudes into the bottle 80 significantly more than the protrusion of the ink-outlet-center-side end of the valve segments 742 into the bottle 80. In the process of putting the cap 68 on the bottle 80, the protruding portion 684 pushes the middle portion located closer to the center of the ink outlet 65 than the outer-circumference-side end of the valve segments 742 is. That is, the protruding portion 684 is arranged in such a way as to push the middle portion of the valve segments 742 that does not include the outer-circumference-side end of the valve segments 742 and is located closer to the center of the ink outlet 65 than the outer-circumference-side end is.

Therefore, in a cap-on state, each valve segment 742 deforms in such a way that the ink-outlet-center-side end of the valve segment 742 is located deeper into the bottle 80 in the direction of the central axis CX than the outer-circumference-side end of the valve segment 742 is. The middle portion of the valve segment 742 is an area that is located at an inner region than the portion corresponding to the outer circumference of the protruding portion 684 as indicated by broken-line illustration in FIG. 8 and does not include the outer-circumference-side end of the valve segment 742.

Figure 16:
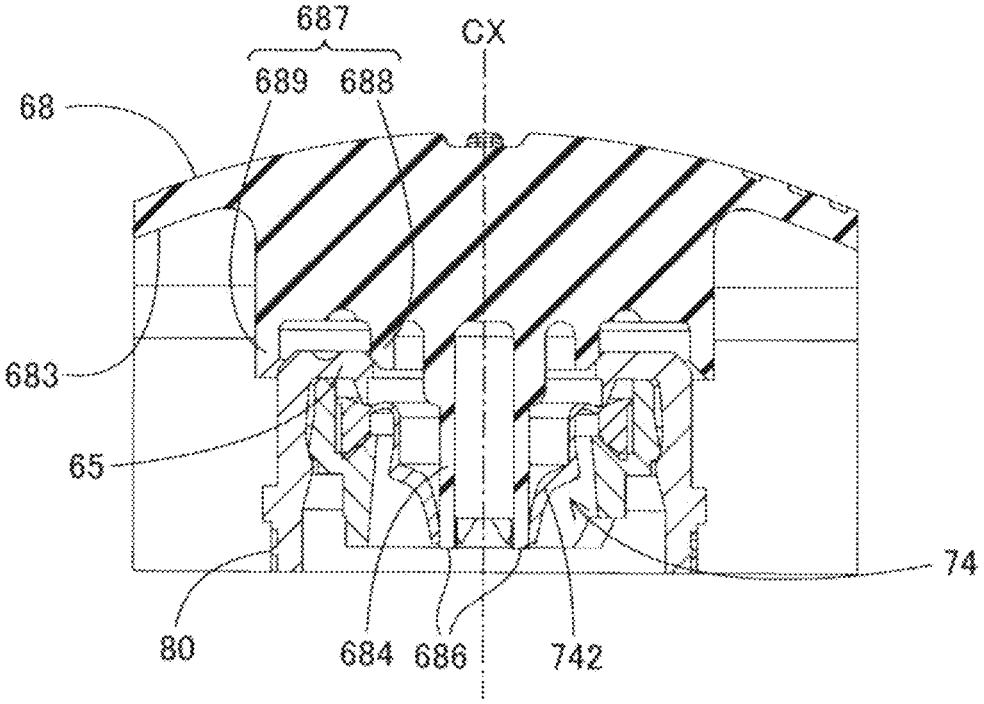
FIG. 16 is a cross-sectional view showing a state in which the protruding portion is being pulled out from the valve.

FIG. 16 is a cross-sectional view showing a state in which the protruding portion 684 is being pulled out from the valve 74. FIG. 16 depicts a state of the protruding portion 684 and the valve 74 immediately before the seal provided by the sealing portion 687 is unsealed in the process of disengagement of the cap 68 and the bottle 80 from each other due to relative rotation of the first thread portion 69 and the second thread portion 681. The sealing of the ink outlet 65 by the sealing portion 687 is unsealed when, in the process of disengagement of the cap 68 and the bottle 80 from each other due to the screw rotation, the disengagement further advances from the state illustrated in FIG. 16. In the present embodiment, in a state in which the sealing of the ink outlet 65 by the sealing portion 687 has been unsealed in the process of disengagement of the cap 68 and the bottle 80 from each other due to the screw rotation, the tip end of the protruding portion 684 is still inserted inside the bottle 80 through the valve segments 742. Then, upon the disengagement of the cap 68 and the bottle 80 from each other, the protruding portion 684 is pulled out from the valve segments 742.

In the present embodiment, in the process of detachment of the cap 68 from the bottle 80, due to the screw rotation, the protruding portion 684, including the small protrusions 686, is in contact with each valve segment 742 while rotating. Due to this rotation, the state of contact of each valve segment 742 and the protruding portion 684 changes. Even if the internal pressure of the ink containing portion 76 has become high due to a rise in temperature, etc., such a change in the state of contact makes it easier for air inside the ink containing portion 76 to escape through the gap between each valve segment 742 and the protruding portion 684. Therefore, air inside the ink containing portion 76 escapes toward the cap 68. This results in a decrease in the internal pressure of the ink containing portion 76. In the present embodiment, it is easier to form a gap between each valve segment 742 and the protruding portion 684 especially because the protruding portion 684 has a plurality of small protrusions 686 at its tip end. Therefore, it is easier to decrease the internal pressure of the ink containing portion 76.

In the present embodiment, as described above, the protruding portion 684 provided on the cap 68 is inserted into the bottle 80 through the slits 75 at the center region of the ink outlet 65 in a sealed state in which the cap 68 is in thread engagement with the bottle 80. For this reason, as compared with a case where the protruding portion 684 pushes the outer-circumference-side end of each valve segment 742, each valve segment 742 is less susceptible to creep deformation. Therefore, the slits 75 are less likely to remain open when the cap 68 is detached from the bottle 80, and staining due to spilling of ink is unlikely to occur even if the ink outlet 65 of the bottle 80 without the cap 68 is directed downward. In particular, in the present embodiment, since the protruding portion 684 is provided on the cap 68 in such a way as to push the middle portion of the valve segments 742, which is located closer to the center of the ink outlet 65 than the outer-circumference-side end is, it is easier for the protruding portion 684 to push the valve segments 742 at the center region of the ink outlet 65. Therefore, it is possible to prevent the creep deformation of the valve segments 742 more effectively, thereby reducing the risk of staining due to spilling of ink from the ink outlet 65.

Moreover, in the present embodiment, the tip end of the protruding portion 684 is configured to be inserted in the slits 75 in a state in which the seal provided by the sealing portion 687 is unsealed in the process of disengagement of the cap 68 and the bottle 80 from each other due to the screw rotation. Because of this configuration, the degree of entry of air and/or the ink IK into the gap between the protruding portion 684 and the valve segments 742 varies due to the screw-rotating operation when the cap 68 is detached from the bottle 80. Therefore, it is easier to release the pressure that has increased inside the bottle 80. Therefore, it is possible to prevent the content of the bottle 80 from spouting due to the exceeding of the sum of the increased pressure and the liquid head pressure of the content over the pressure resistance of the valve 74 when the bottle 80 is turned upside down.

Furthermore, in the present embodiment, the protruding portion 684 has, at its tip end, the small protrusions 686 protruding in the direction of the central axis CX2 of the barrel portion 682. Therefore, the small protrusions 686 push and release the valve segments 742 in turns due to the screw-rotating operation when the cap 68 is detached from the bottle 80. For this reason, a gap is formed by relative displacement of the valve segments 742 in the top/bottom direction, and the gap makes it easier for the internal pressure of the container body portion 64 to be released gradually. Therefore, it is possible to more effectively prevent the content of the bottle 80 from spouting due to the exceeding of the sum of the increased pressure and the liquid head pressure of the content over the pressure resistance of the valve 74 when the bottle 80 is turned upside down.

Furthermore, in the present embodiment, the number of the small protrusions 686 provided at the tip end of the protruding portion 684 is less than the number of the valve segments 742. If many small protrusions 686 were inserted into the valve segments 742, the whole of the valve segments 742 would be pushed. This would make it difficult to form a gap by relative displacement of the valve segments 742. In this respect, since the number of the small protrusions 686 is less than the number of the valve segments 742, it is easy to form a gap, and air passes easily. Therefore, it is possible to release the pressure inside the bottle 80 smoothly.

B. Second Embodiment

Figure 17:
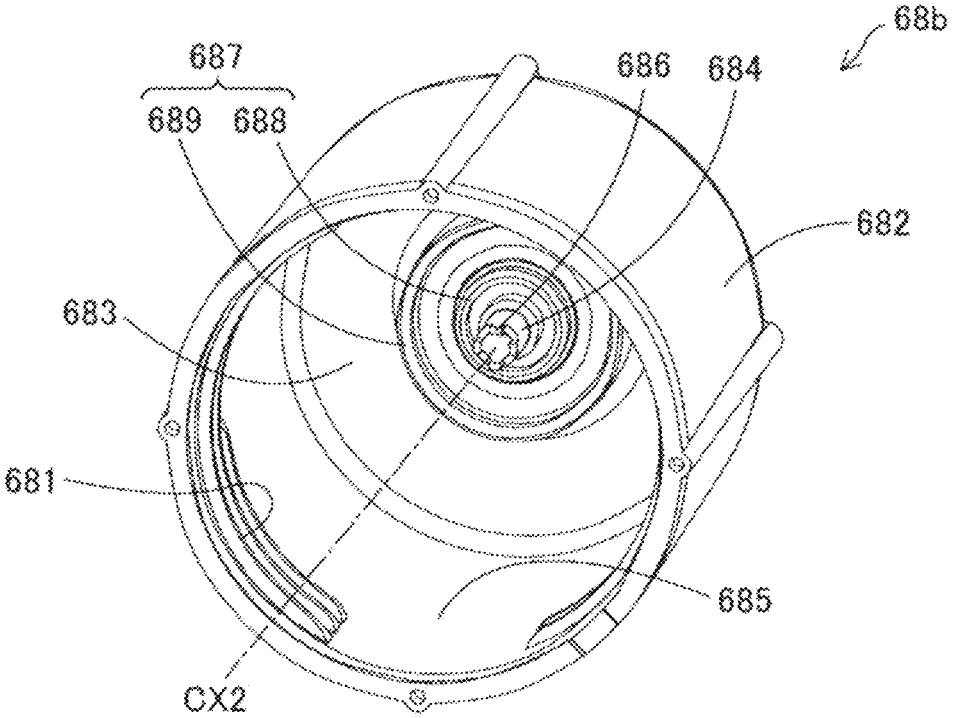
FIG. 17 is a perspective view showing an inner shape of a cap according to a second embodiment.
Figure 18:
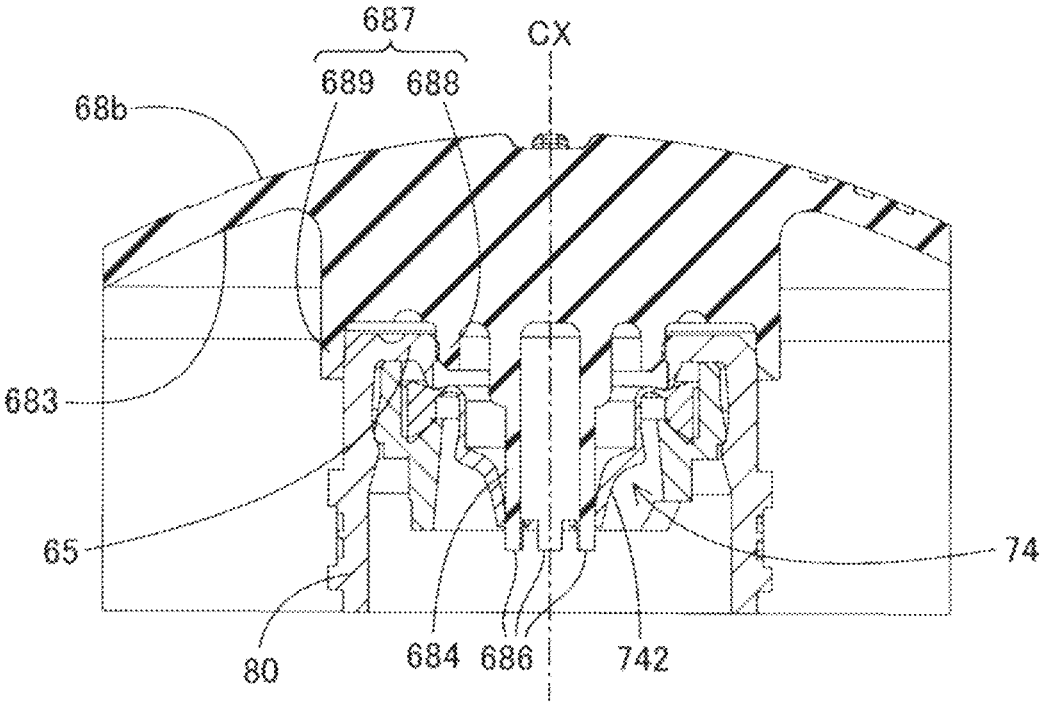
FIG. 18 is a cross-sectional view showing a positional relationship between a protruding portion and a valve according to the second embodiment.
Figure 19:
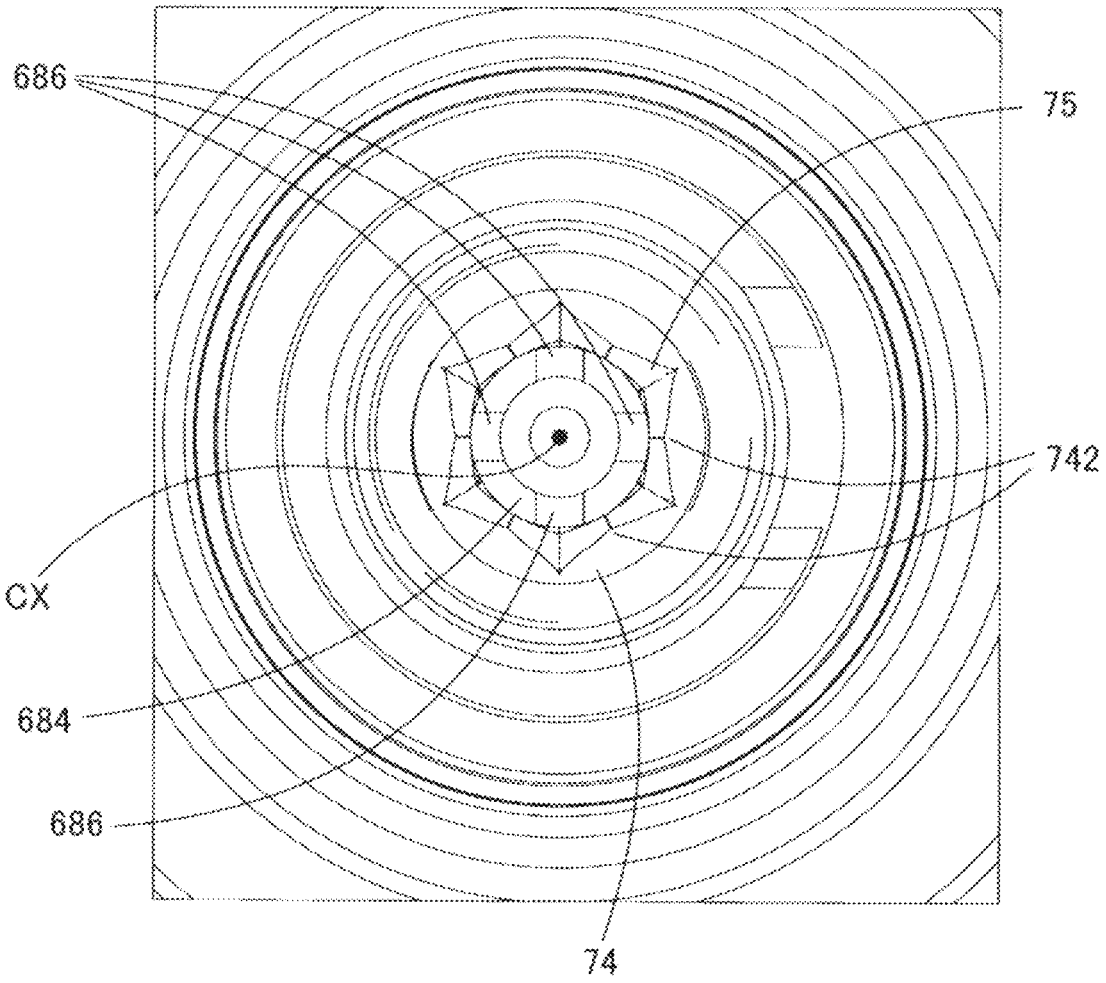
FIG. 19 is a view of the positional relationship between the protruding portion and the valve, seen from the inside of a spout portion, according to the second embodiment.

FIG. 17 is a perspective view showing an inner shape of a cap 68*b* according to a second embodiment. FIG. 18 is a cross-sectional view showing a positional relationship between the protruding portion 684 and the valve 74 according to the second embodiment. FIG. 19 is a view of the positional relationship between the protruding portion 684 and the valve 74 in a cap-on state according to the second embodiment, seen from the inside of the spout portion 150.

In the first embodiment, the number of the small protrusions 686 provided on the protruding portion 684 of the cap 68 is two. By contrast, the cap 68*b* according to the second embodiment has four small protrusions 686 at the tip end of the protruding portion 684. The small protrusions 686 are provided at equal intervals in the circumferential direction along the outer circumference of the protruding portion 684.

Even with this modified configuration, the small protrusions 686 push and release the valve segments 742 in turns due to the screw-rotating operation when the cap 68*b* is detached from the bottle 80. For this reason, a gap is formed by relative displacement of the valve segments 742 in the top/bottom direction, and the gap makes it easier for the internal pressure of the container body portion 64 to be released gradually. Therefore, it is possible to effectively prevent the content of the bottle 80 from spouting due to the exceeding of the sum of the increased pressure and the liquid head pressure of the content over the pressure resistance of the valve 74 when the bottle 80 is turned upside down.

C. Other Embodiments

C-1

In the foregoing embodiments, the tip end of the protruding portion 684 is configured to be inserted in the inside of the bottle 80 through the slits 75 in a state in which the seal provided by the sealing portion 687 is unsealed in the process of disengagement of the cap 68 and the bottle 80 from each other due to the screw rotation. However, the tip end of the protruding portion 684 may be configured to be not inserted into the inside of the bottle 80 through the slits 75 in a state in which the seal provided by the sealing portion 687 has been unsealed in the process of disengagement of the cap 68 and the bottle 80 from each other due to the screw rotation, and may be in a state of push-widening the slits 75. The tip end of the protruding portion 684 may be configured to be not in contact with the valve segments 742 in a state in which the seal provided by the sealing portion 687 has been unsealed in the process of disengagement of the cap 68 and the bottle 80 from each other due to the screw rotation.

C-2

In the foregoing embodiments, the protruding portion 684 provided on the cap 68 has the small protrusions 686. However, the protruding portion 684 may be configured not to have the small protrusions 686.

C-3

In the foregoing embodiments, the number of the small protrusions 686 is two or four. However, the number of the small protrusions 686 is not limited to two or four. The number of the small protrusions 686 may be one, three, or five or more depending on the number of the valve segments 742. The number of the small protrusions 686 may be equal to or greater than the number of the valve segments 742.

D. Other Configurations

The scope of the present disclosure is not limited to the foregoing embodiments. The present disclosure may be modified in various ways within a range of not departing from its spirit. For example, technical features in embodiments corresponding to technical features in aspects and modes described below may be replaced or combined in order to solve a part of a whole of the aforementioned problems or produce a part of a whole of the aforementioned effects. Some technical features may be deleted where unnecessary unless they are explained explicitly as indispensable in this specification.

(1) In a first aspect of the present disclosure, an ink refilling container is provided. The ink refilling container includes: a bottle; and a cap configured to be put on the bottle detachably; the bottle including an ink outlet forming portion that includes an ink outlet, a valve provided inside the ink outlet and an outer circumferential portion, the ink outlet having a cylindrical shape, the outer circumferential portion having a first thread portion, wherein the valve is made of an elastic material and includes valve segments segmented by at least one slit extending in a radial direction from a center of the ink outlet toward an outer circumference; the cap including a barrel portion having a cylindrical shape and including an inner circumferential portion on which a second thread portion configured to engage with the first thread portion is formed; and a top portion configured to face the ink outlet when the cap is put on the bottle; wherein a protruding portion extending in a direction of a central axis of the barrel portion is provided at a center of the top portion, a sealing portion having an annular shape is provided on the top portion outside the protruding portion in the radial direction, a radius of the protruding portion is set to be less than a length of the slit as viewed in a direction of a central axis of the ink outlet when the valve is closed, and in a sealed state in which the cap is in thread engagement with the bottle and in which the sealing portion seals the ink outlet tightly, a tip end of the protruding portion is inserted in an inside of the bottle through the slit at a center region of the ink outlet as viewed in the direction of the central axis of the ink outlet.

In the above aspect, the tip end of the protruding portion provided on the cap is inserted in the bottle through the slits at the center region of the ink outlet in a sealed state in which the cap is in thread engagement with the bottle. For this reason, as compared with a case where the protruding portion pushes the outer-circumference-side end of each valve segment, each valve segment is less susceptible to creep deformation. Therefore, the slits are less likely to remain open, and staining due to spilling of ink is unlikely to occur even if the ink outlet of the bottle without the cap is directed downward.

(2) In the above aspect, the protruding portion may be arranged in such a way as to push a middle portion that does not include an outer-circumference-side end of the valve segments and is located closer to the center of the ink outlet than the outer-circumference-side end is.

This configuration makes it easier for the protruding portion to push the valve segments at the center region of the ink outlet. Therefore, it is possible to prevent the creep deformation of the valve segments more effectively, thereby reducing the risk of staining due to spilling of ink from the ink outlet.

(3) In the above aspect, the tip end of the protruding portion may be configured to be inserted in the inside of the bottle through the slits in a state in which the seal provided by the sealing portion is unsealed in the process of disengagement of the cap and the bottle from each other due to the screw rotation.

Because of this configuration, the degree of entry of air and/or ink into the gap between the protruding portion and the valve segments varies due to the screw-rotating operation when the cap is detached from the bottle. Therefore, it is easier to release pressure that has increased inside the bottle.

(4) In the above aspect, the protruding portion may have, at the tip end of the protruding portion, small protrusions protruding in the direction of the central axis of the barrel portion.

With this configuration, the small protrusions push and release the valve segments in turns due to the screw-rotating operation when the cap is detached from the bottle. For this reason, a gap is formed by relative displacement of the valve segments in the top/bottom direction, and the gap makes it easier for the internal pressure of the bottle to be released gradually.

(5) In the above aspect, the number of the small protrusions which the protruding portion has may be less than the number of the valve segments.

If many small protrusions were inserted into the valve segments, the whole of the valve segments would be pushed. This would make it difficult to form a gap by relative displacement of the valve segments. In this respect, since the number of the small protrusions is less than the number of the valve segments, it is easy to form a gap, and air passes easily. Therefore, it is possible to release the pressure inside the bottle smoothly.

What is claimed is:

1. An ink refilling container, comprising:

a bottle; and a cap configured to be put on the bottle detachably;

the bottle including an ink outlet forming portion that includes an ink outlet, a valve provided inside the ink outlet and an outer circumferential portion, the ink outlet having a cylindrical shape, the outer circumferential portion having a first thread portion, wherein the valve is made of an elastic material and includes valve segments segmented by at least one slit extending in a radial direction from a center of the ink outlet toward an outer circumference;

the cap including a barrel portion having a cylindrical shape and including an inner circumferential portion on which a second thread portion configured to engage with the first thread portion is formed; and a top portion configured to face the ink outlet when the cap is put on the bottle; wherein a protruding portion extending in a direction of a central axis of the barrel portion is provided at a center of the top portion, a sealing portion having an annular shape is provided on the top portion outside the protruding portion in the radial direction, a radius of the protruding portion is set to be less than a length of the slit as viewed in a direction of a central axis of the ink outlet when the valve is closed, and in a sealed state in which the cap is in thread engagement with the bottle and in which the sealing portion seals the ink outlet, a tip end of the protruding portion penetrates the valve and is inserted in an inside of the bottle through the slit at a center region of the ink outlet as viewed in the direction of the central axis of the ink outlet.

2. The ink refilling container according to claim 1, wherein the protruding portion is arranged in such a way as to push a middle portion that does not include an outer-circumference-side end of the valve segments and is located closer to the center of the ink outlet than the outer-circumference-side end is.

3. The ink refilling container according to claim 1, wherein the tip end of the protruding portion is configured to be inserted in the inside of the bottle through the slit in a state in which seal provided by the sealing portion is unsealed in a process of disengagement of the cap and the bottle from each other due to the screw rotation.

4. The ink refilling container according to claim 1, wherein the protruding portion has, at the tip end of the protruding portion, small protrusions protruding in the direction of the central axis of the barrel portion.

5. The ink refilling container according to claim 4, wherein a number of the small protrusions which the protruding portion has is less than a number of the valve segments.

* * * * *